US008371967B2

(12) United States Patent
Winningham et al.

(10) Patent No.: US 8,371,967 B2
(45) **Date of Patent: *Feb. 12, 2013**

(54) LACROSSE STICK POCKET AND RELATED METHOD OF MANUFACTURE

(75) Inventors: Matthew M. Winningham, Royal Oak, MI (US); Adam D. Paquette, Leominster, MA (US); Jessica L. Hanson, Royal Oak, MI (US); Richard J. Janisse, Windsor (CA)

(73) Assignee: Warrior Sports, Inc., Warren, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/526,088

(22) Filed: Jun. 18, 2012

(65) Prior Publication Data

US 2012/0255670 A1 Oct. 11, 2012

Related U.S. Application Data

(63) Continuation of application No. 13/046,122, filed on Mar. 11, 2011, which is a continuation-in-part of application No. 12/562,731, filed on Sep. 18, 2009, now Pat. No. 8,235,846.

(60) Provisional application No. 61/098,464, filed on Sep. 19, 2008.

(51) Int. Cl.
*A63B 59/02* (2006.01)
*A63B 65/12* (2006.01)

(52) U.S. Cl. ..... 473/513

(58) Field of Classification Search ..... 473/505, 473/512, 513; D21/724

See application file for complete search history.

(56) References Cited

U.S. PATENT DOCUMENTS

| | | | |
|---|---|---|---|
| 4,022,477 | A | 5/1977 | Pool |
| 4,049,273 | A | 9/1977 | Pool |
| 4,153,251 | A | 5/1979 | Pond |
| 4,273,331 | A | 6/1981 | Fischer |
| 4,460,178 | A | 7/1984 | Ulman |
| 4,861,042 | A | 8/1989 | Trettin |
| 4,938,480 | A | 7/1990 | Lods |
| D318,509 | S | 7/1991 | Naumburg, Jr. |
| 5,920,970 | A | 7/1999 | Coblentz |
| 5,957,791 | A | 9/1999 | Nichols et al. |

(Continued)

FOREIGN PATENT DOCUMENTS

| | | |
|---|---|---|
| CA | 2326206 | 5/2001 |
| CA | 2359858 | 4/2002 |

OTHER PUBLICATIONS

Photo of deBeer Lacrosse Head.

*Primary Examiner* — Gene Kim
*Assistant Examiner* — M Chambers
(74) *Attorney, Agent, or Firm* — Warner Norcross & Judd LLP

(57) ABSTRACT

A lacrosse head pocket includes an elongated single layer runner with multiple cross pieces. The single layer runner can be constructed from a material, such as a polymeric material, molded over the cross pieces. The cross pieces and/or runner can include speed lace loops with which a net lace can be joined. A related method includes providing cross pieces, overmolding a polymeric material over the cross pieces to form a single layer runner, where the overmolded material is the only structure extending between and connecting the cross pieces, and where the cross pieces are transverse to the runners. Another method includes providing a pocket base overmolding the base with a polymeric material to cover portions of it, and forming connection elements between different portions independently of any other components of the pocket base.

14 Claims, 20 Drawing Sheets

U.S. PATENT DOCUMENTS

| | | | | |
|---|---|---|---|---|
| 6,213,901 | B1 | 4/2001 | Collinson | |
| 6,447,410 | B2 | 9/2002 | Crawford | |
| 6,506,132 | B1 | 1/2003 | Brine, III et al. | |
| 6,520,875 | B1 | 2/2003 | Crawford | |
| 6,533,686 | B2 | 3/2003 | LeMire | |
| 6,626,774 | B2 | 9/2003 | Sorbie | |
| 6,641,492 | B2 | 11/2003 | LeMire | |
| 6,852,047 | B2 | 2/2005 | Tucker, Sr. | |
| 6,966,854 | B1 | 11/2005 | Gait | |
| 7,022,035 | B2 | 4/2006 | Morrow et al. | |
| 7,070,523 | B1 | 7/2006 | Gait | |
| 7,192,369 | B2 | 3/2007 | Morrow | |
| 7,211,009 | B2 | 5/2007 | Samaras et al | |
| 7,238,128 | B1 | 7/2007 | Filice et al. | |
| 7,278,936 | B2 | 10/2007 | Tucker, Jr. | |
| 7,331,884 | B2 | 2/2008 | Samaras et al. | |
| 7,364,519 | B1 | 4/2008 | Gait | |
| 7,390,275 | B1 | 6/2008 | Gait | |
| 7,503,859 | B1 | 3/2009 | Gait | |
| 7,507,171 | B2 | 3/2009 | Gait | |
| 7,524,253 | B1 | 4/2009 | Gait | |
| 7,963,867 | B1 | 6/2011 | Gait | |
| 8,235,846 | B2 * | 8/2012 | Winningham et al. | 473/513 |
| 2001/0044347 | A1 | 11/2001 | Crawford | |
| 2002/0107094 | A1 | 8/2002 | LeMire | |
| 2002/0160865 | A1 | 10/2002 | Brine, III et al. | |
| 2002/0173389 | A1 | 11/2002 | Morrow | |
| 2003/0100388 | A1 | 5/2003 | LeMire | |
| 2003/0181270 | A1 | 9/2003 | Morrow et al. | |
| 2005/0010142 | A1 | 1/2005 | Kim | |
| 2006/0194655 | A1 | 8/2006 | Tucker, Sr. et al. | |
| 2007/0191153 | A1 | 8/2007 | Gait | |
| 2008/0146385 | A1 | 6/2008 | Lundberg | |
| 2008/0146387 | A1 | 6/2008 | Gait | |
| 2008/0214335 | A1 | 9/2008 | Lamson et al. | |
| 2008/0214336 | A1 | 9/2008 | Lamson et al. | |
| 2008/0268987 | A1 | 10/2008 | Lignelli et al. | |
| 2011/0160007 | A1 * | 6/2011 | Winningham et al. | 473/513 |

* cited by examiner

LACROSSE STICK POCKET AND RELATED METHOD OF MANUFACTURE

BACKGROUND OF THE INVENTION

The present invention relates generally to lacrosse equipment, and more particularly, to a lacrosse stick pocket and a related method of manufacture.

Conventional lacrosse sticks include a head joined with a handle. The head includes a frame that forms a region within which a lacrosse ball can be caught, held or shot. A netting structure is joined with the back side of the frame, typically laced through multiple small holes defined by the frame. The netting structure typically forms a pocket within which the ball is held while a player is in possession of the ball, and can be a determinant factor as to the player's ability to catch, retain and shoot the ball.

Typically, different players at different positions prefer pockets having certain properties and certain configurations. For example, while a player at an attack position generally prefers a relatively shallow pocket for the quick release and accurate shooting of a lacrosse ball, a midfielder prefers a deeper pocket, so that they can better control and safely carry a ball by cradling it back and forth, causing the ball to snugly set in the pocket due to the centrifugal force produced by the cradling. Further, depending on the particular player, they may prefer a modification of the pocket. For example, an attacker may prefer their shooting strings, which generally form the ramp of the pocket from which the lacrosse ball is shot, to be at a certain angle, or at to have a particular resilience.

With many conventional pockets, however, it is frequently difficult to accommodate these player preferences without significant knowledge and experience about how to modify the netting so that the pocket has a specific profile and performs as desired. Further, when conventional pockets wear out after extensive play, the mere thought of replacing it can be daunting to many, particularly younger or less experienced lacrosse players. The reason for this is because most pockets require a complex lacing procedure, which is mastered by only a limited number of individuals, to secure the netting to a lacrosse frame in a desired pocket configuration. Thus, many lacrosse players, particularly youths and newcomers to the sport, are left at the mercy of having to wait for their lacrosse sticks to be restrung by someone else, and even then, after the pocket is strung, they usually must wait several weeks or months until it is properly broken in.

In addition to conventional lacrosse pockets being difficult to customize and replace, they usually are affected by climate. For example, even where netting is woven or otherwise constructed from filaments of nylon or polypropylene, when wetted by a rain, the netting of the pocket can shrink or become slippery, which can significantly alter how a lacrosse ball is shot from the pocket. This can lead to inconsistent shooting, which can be detrimental to the player's performance.

Some manufacturers have attempted to resolve the above issues, but few have succeeded. One approach is implemented in a pocket called the deBeer Gripper Pro, commercially available from J. deBeer & Son of Altamont, N.Y. The technology of this pocket is presented in U.S. Pat. No. 7,524,253 to Gait, which generally describes a pre-formed pocket including runners having two layers of multiple types of different materials and perpendicular cross pieces strung between the runners. A first layer includes a polyurethane material that is joined with a braided nylon web. A second layer also includes a polyurethane material joined with another braided nylon web. The first and second layers are sandwiched and machine stitched together in some areas, but separated in other areas to form openings between the layers. The openings are large enough so that the cross pieces can be loosely inserted through them. The cross pieces or other laces are then laced through openings in the lacrosse head frame.

While this construction provides an easy-to-install runner system, it requires a skill to precisely position and connect the cross pieces to the multilayered runners, which skill may not be possessed by younger or inexperienced players. Moreover, although the polyurethane and braided nylon layers work well, the layering of different materials requires additional assembly time. The extra machine stitching and sewing to join the various layers also requires additional assembly time and resources. Thus, while the above systems work, there remains room for improvement.

SUMMARY OF THE INVENTION

A lacrosse head is provided that includes a pocket that is durable and easy to replace relative to the lacrosse head. A method for making the pocket is also provided.

In one embodiment, the pocket includes an elongate single layer runner or thong constructed from a material, such as a polymeric material, overmolded over a first cross piece and the second cross piece so that the material encapsulates at least a portion of these pieces. The single layer runner can be generally transverse to each cross piece, and optionally perpendicular to the cross pieces. Further optionally, the cross pieces include speed loops that are adapted to receive a net lace to join the pocket with a frame of a lacrosse head.

In another embodiment, the pocket can include a throat tie having a throat tie end. The polymeric material can be molded over the throat tie so that the material encapsulates at least a portion of the throat tie end.

In still another embodiment, a method for manufacturing the lacrosse pocket is provided. The method includes providing cross pieces having first and second opposing ends; overmolding a material over the cross pieces to form first and second single layer runners with the material, where the overmolded material is the only structure extending between connecting the first cross piece and a second cross piece; where the first cross piece and second cross piece are transverse to the first and second single layer runners.

In still another alternative embodiment, a method for manufacturing a lacrosse pocket is provided. The method includes forming portions of a single layer runner with a chamfered and/or rounded contact surface on a side opposite to the side having a speed loop. The chamfered and/or rounded contact surface reduces surface variations along portions of the single layer runner that contact a lacrosse ball during use, and also increases the area of contact between the single layer runner and the lacrosse ball during use. The chamfered and/or rounded contact surface can also help channel the ball specifically and consistently along a desired shooting channel defined by the opposing single layer runners. In turn, this can provide improved directional control on the ball, and thereby improve the accuracy of shooting from the pocket.

In yet another alternative embodiment, the method includes forming multiple ridges on the single layer runner, where the multiple ridges are adapted to face the front side of the lacrosse head. Further, the ridges can include a chamfered and/or rounded contact surface.

In yet another embodiment, the method includes providing a throat tie and overmolding the material over at least a portion of the throat tie so that the material joins the throat tie with the cross pieces.

In a still yet another embodiment, a pocket for a lacrosse head includes a runner base layer, a first piece joined at a junction with the runner base layer, with the first piece being transverse to the runner base layer. An overmold layer is molded over at least a portion of the runner, a portion of the first piece, and the junction. A separate molded connection element is formed by the overmolded layer that spans between and connects the runner and the first piece. The separate molded connection element is spaced away from and independent from the junction.

In a further embodiment, the lacrosse head pocket first piece is a side piece that extends outwardly and laterally away from the runner base layer toward at least an opposing sidewall of the lacrosse head. The side piece, however, optionally may not extend beyond the runner base layer toward the other opposing sidewall.

In yet a further embodiment the first piece is a shooting string that is transverse to the runner and extends from one opposing sidewall to the other opposing sidewall.

In still a further embodiment, the first piece includes a speed loop at the end thereof. The speed loop can define an opening through which a net lace is positioned. The speed loop of the first piece can extend beyond the sidewalls and can be connected directly to the sidewalls with the net lace.

In still yet a further embodiment, the method for making the pocket for a lacrosse head is provided. The method can include providing a runner joined at a junction with a first piece, the first piece being transverse to the runner; molding the material over at least a portion of the runner and the junction; and molding the material so that it forms a separate connection element that spans between and connects the runner and the first piece, the connection element being spaced away from and independent from the junction.

In another further embodiment, the runner can include a throat tie and the method can include molding the material over the throat tie so that a portion of the throat tie remains unmolded. Optionally the runner and the throat tie and/or first piece can be sewn together at the junction described above.

In yet another further embodiment, the pocket components, such as the single layer runners can be constructed from an polymeric material, for example, thermoplastic elastomer polymers, such as thermoplastic polyurethane (TPU), thermoplastic copolyester, thermoplastic polyamides, polyolefin blends, styrenic block polymers, and/or elastomeric alloys, as well as rubber, formable but flexible resins, hydrophobic flexible materials, and/or other similar flexible materials.

In another further alternative embodiment, a method for making the pocket for a lacrosse head is provided. The method can include overmolding a polymeric material over the throat tie and the plurality of cross pieces while they are maintained in a predetermined spatial relationship using pins. Optionally, the pins can hold the throat tie and cross pieces so when the polymeric material is injected, it does not force these components from a desired orientation relative to each other and/or the mold. These pins can leave holes in the polymeric material after the polymeric layer is molded.

In yet another alternative embodiment, a method for lacing a pocket for a lacrosse head is provided. The method includes passing a single lace through each of the speed lace loops of cross pieces such that the single lace runs substantially parallel to a first runner and optionally substantially parallel to a second runner.

The lacrosse pocket and method herein provide a lacrosse net structure that is easily replaceable relative to a lacrosse head, even by youth and newcomers to the sport. Multiple different, custom pocket profiles can be formed with the present method, thereby offering a high degree of pocket customization to lacrosse players, without those players having to have significant knowledge and experience in shaping and fitting a pocket, and without having to pay someone else to install the netting structure.

Further, where the material is constructed from hydrophobic or waterproof materials, the netting is virtually unaffected by weather changes, temperature changes and moisture, which enables it to have a substantially consistent profile and configuration throughout such conditions. In turn, this enables the player to play with confidence, even under adverse environmental conditions.

These and other objects, advantages, and features of the invention will be more fully understood and appreciated by reference to the description of the current embodiment and the drawings.

DETAILED DESCRIPTION OF THE CURRENT EMBODIMENTS

I. Overview

Figure 1:
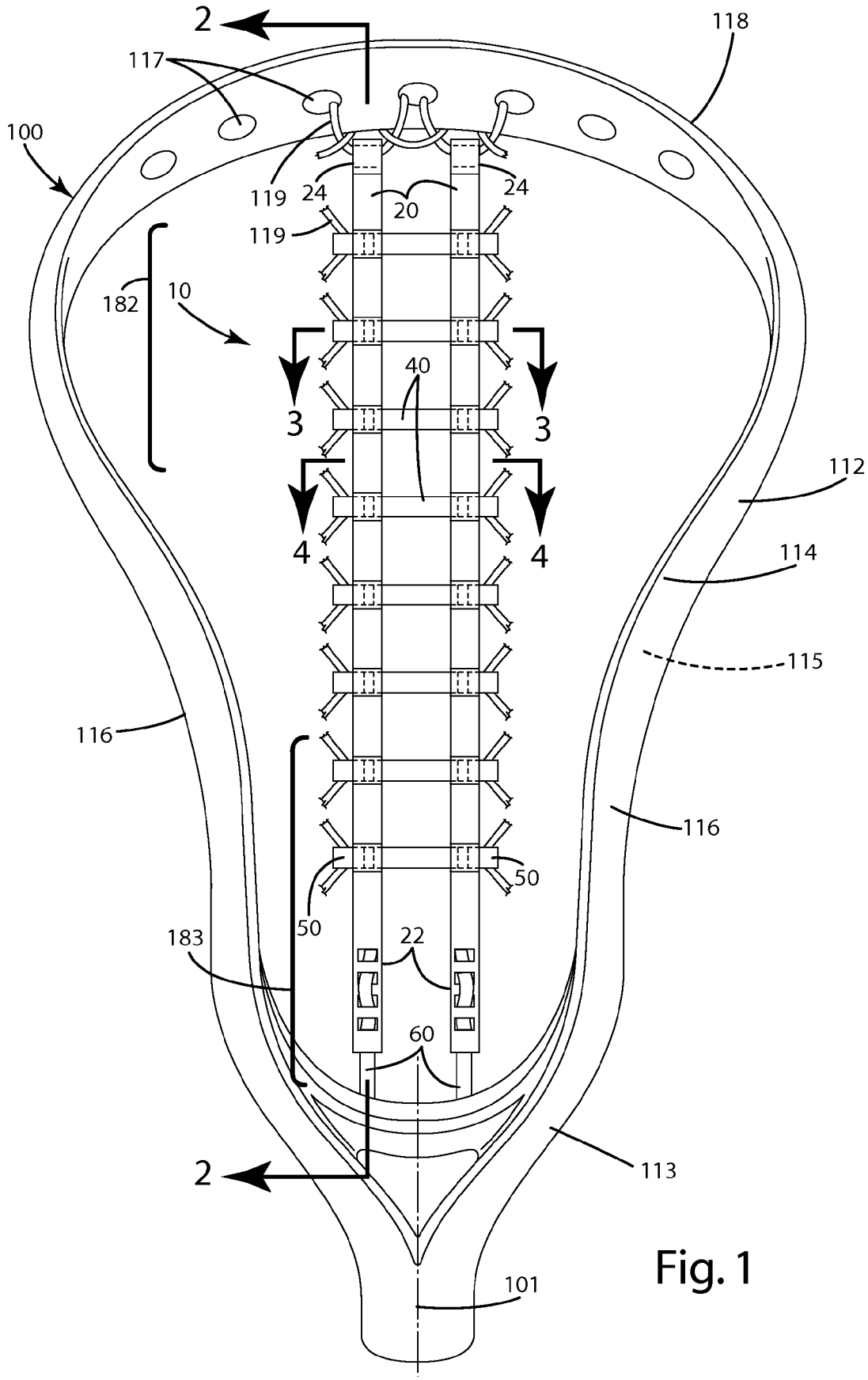
FIG. 1 is a front view of a lacrosse head including a current embodiment of a lacrosse pocket installed thereon.

A current embodiment of a lacrosse head pocket is shown in FIGS. 1-7 and generally designated 10. The lacrosse head pocket 10 is secured to a frame 112 to form a strung lacrosse head 100. The lacrosse head 100 can be further joined with a handle (not shown) to form a lacrosse stick. As shown in FIG. 1, the lacrosse pocket 10 includes one and optionally two runners or thongs 20 which are longitudinally disposed along the axis 101 of the lacrosse head. Although shown as being generally parallel to the axis 101, the runners 20 can diverge or converge toward one another as they approach the base 113 or the scoop 118. Further, the runners 20 optionally can be equidistant from each other. The respective runners 20 can be formed as elongate single layer runners overmolded over portions of the cross pieces 40. The cross pieces can generally be transverse, and optionally perpendicular, to the runners 20. The single layer runners 20 generally hold the cross pieces in a predetermined spatial relationship relative to one another. Where included, a throat tie 60 can also be overmolded at least partially by the single layer runners 20.

In the embodiment illustrated in FIG. 1, the material used to form the runners 20 can be a polymeric material, as described below, while the cross pieces 40 and the throat tie can be a second material, such as a braided nylon web or other material as described below. The respective cross pieces 40 can each include speed laces 50 that extend laterally beyond the runners 20. These speed laces can define openings that are adapted to receive a net lace 119 therethrough. The overmolded material, from which the single layer runners are constructed, can be the only material extending between and connecting the adjacent cross pieces.

II. Construction

Construction of the current embodiment of FIGS. 1-7 will now be described. In this embodiment, the pocket 10 is described generally in connection with a women's lacrosse head 100. The pocket, however, can be readily used with men's lacrosse heads as well. The pocket 10 can be joined with a lacrosse head 100, and in particular, the frame 112, which includes a base 113, a pair of opposing sidewalls 116, and a scoop 118 joining the pair of opposing sidewalls opposite the base. The lacrosse head 100 can include a socket extending rearward from the frame 112 for attachment to a lacrosse handle (not shown). The frame 112 can include a front side 114 and a rear side 115 opposite the front side. A lacrosse ball can be caught or shot through the front side 114.

The sidewalls 116 and/or scoop can define multiple netting structure connections 117, which as shown, are holes that pass through the scoop, sidewalls or the frame. Optionally, the netting structure connections can vary in number, size and location from those shown in the figures. Even further optionally, depending on the application, the netting structure connections can be replaced with other alternative structures, such as a series of hooks or posts (not shown) that allow the attachment ends of the netting structure to be joined with the frame 112.

Figure 2:
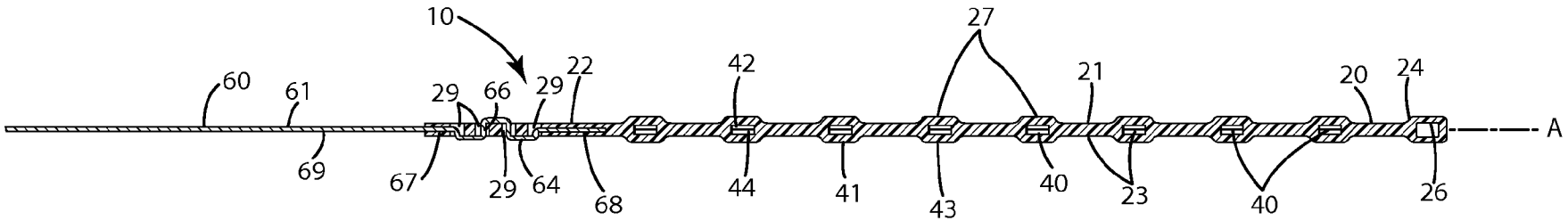
FIG. 2 is a cross section view of the lacrosse pocket.

The pocket 10 can be joined with the frame 112 in a variety of manners. For example, the cross pieces 40 are joined with the frame 112 via lacing 119, which extends directly or indirectly to the frame 112. The single layer runner 20 can be joined with throat ties 60 that extend generally from the first end 22 of the single layer runners 20 toward the base 113. The throat ties 60 can be tied in a conventional manner to the frame 112. As illustrated in FIG. 2, the scoop end 24 of the single layer runners can define an opening 26 through which a net lace 119, but optionally not any cross pieces, is threaded and further connected through netting holes 117 in the scoop 118. The pocket 10 can also be connected to the sidewalls and other portions of the frame element 113 via additional net lacing 119 which is threaded through openings in the speed lace loops 50 of the cross pieces 40.

Referring to FIG. 2, an elongate single layer runner 20 can be constructed from a single layer of material that is overmolded over multiple cross pieces 40. The single layer runner 20 can be the only structure connecting adjacent cross pieces, for example cross piece 41 and 43 in FIG. 2. Accordingly, there optionally can be no separate, independent pieces or different layers included in the single layer runners. The material of the single layer runner can encapsulate and cover at least a portion of the front surface 42 and a rear surface 44 of the cross pieces 40. Due to the overmolding process used to produce the single layer runner, the portions of the upper surface 42 and the lower surface 44 of the cross pieces 40 optionally can become encapsulated by the overmolded material so that no openings are formed through the single layer runner. With this overmolding, the cross pieces can be immoveable laterally relative to the single layer runner. This can provide added integrity and structural rigidity to the pocket 10. Optionally, single layer runners can be joined together via a linking member (not shown). The linking member can be formed during the overmolding process using material similar to that of the single layer runners. The linking member can be between cross pieces 40 and extend from one single layer runner to another single layer runner. Optionally, the linking member can be centered between cross pieces 40.

Optionally, if desired, the cross pieces can be joined with the elongate single layer runners so that they are movable relative thereto. For example, the cross pieces can move laterally, side-to-side, through the openings. To create this construction, the runners can first be molded with openings therethrough. Then, the cross pieces can be placed transversely through the openings, and left to freely slide or move in the openings. Further optionally, no other elements or structures join the adjacent cross pieces 41 and 43, other than the single layer runner.

The single layer runners 20 can include a first surface 21 and a second surface 23. The first surface 21 can generally face the front side of the head 114 while the rear surface 23 can generally face the rear side 115 of the head 100. The thickness of the respective single layer runners 20 between the front surface and the back surface between the ridges can range from about 1 millimeter to about 5 millimeters, optionally about 2 millimeters to about 3 millimeters, further optionally about 2.3 millimeters. The total thickness of the single layer runner in the regions where the cross pieces 40 are encapsulated and overmolded by the material can be about 4 millimeters to about 10 millimeters, optionally about 5 millimeters to about 7 millimeters, and further optionally about 6 millimeters. The total width of a single layer runner from one side to the other side can be about 5 millimeters to about 15 millimeters, optionally about 7 millimeters to about 13 millimeters, further optionally about 8 millimeters to about 11 millimeters, and even further optionally about 9 millimeters in width. The runners 20 from the scoop end 24 to the throat tie end 24 can generally be of a length suitable for the appropriate lacrosse head, generally ranging from about 22 centimeters to about 28 centimeters, optionally from about 23 centimeters to about 25 centimeters, and further optionally about 24 centimeters. Of course other dimensions may be suitable depending on the application.

Figure 3:
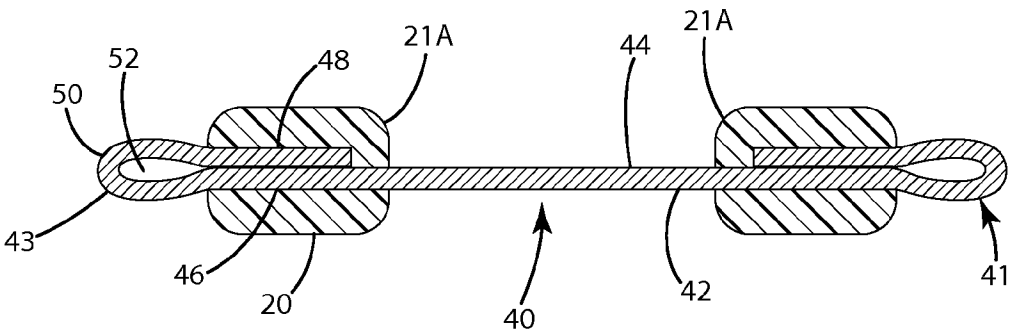
FIG. 3 is a cross section view of the lacrosse pocket taken along line 3-3 of FIG. 1.
Figure 4:
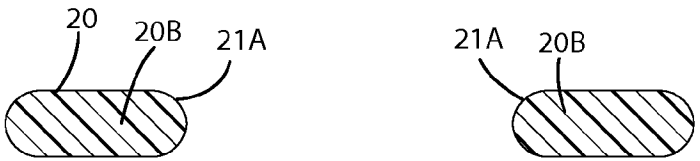
FIG. 4 is a cross section view of the lacrosse pocket taken along line 4-4 of FIG. 1.

With respect to each individual single layer runner, the cross section can vary. As shown in FIGS. 3 and 4, the runners can be rectangular with rounded edges between the cross pieces. Of course, the cross section can be of a variety of other shapes, including circular, triangular, square, diamond shaped, polygonal or irregular shapes. Furthermore, different portions of the single layer runners can have different densities depending on the desired flexibility or grip characteristics of the single layer runners. For example, in the ramp region 182, the thickness of the single layer runners can be thicker from the runner front surface 21 to the rear surface 23, while the single layer runners 120 in the pocket region 183 can be of a different thickness from front surface to rear surface. Optionally, the runners in the ramp region can be 2, 2.5, 3, 3.5 or 4 times more than the thickness of the runners 20 in the pocket region near the ball stop region 183.

In the embodiments illustrated in FIGS. 3 and 4, the single layer runners 20 can include a contact surface 21A on the front surface 21. The contact surface 21A can be constructed to smooth the contour of the front surface 21 along which a lacrosse ball travels. Put another way, the contact surface 21A may increase retention of the lacrosse ball in the pocket 10 by increasing the area of contact between the lacrosse ball and the front surface 21 or by having fewer large bulges or large depressions in the contact surface 21A.

In configurations where the pocket 10 includes a pair of single layer runners 20 adjacent to each other, the two contact surfaces 21A of the single layer runners 20 can be opposed to each other so that when the player catches, holds, or shoots the lacrosse ball, the lacrosse ball may contact both contact surfaces 21A. As the ball sits in the pocket 10 or as the ball travels along the contact surfaces 21A, the increased contact area may improve channeling of the ball and result in greater ball retention, control, shooting accuracy, or combinations or the foregoing.

Figure 41:
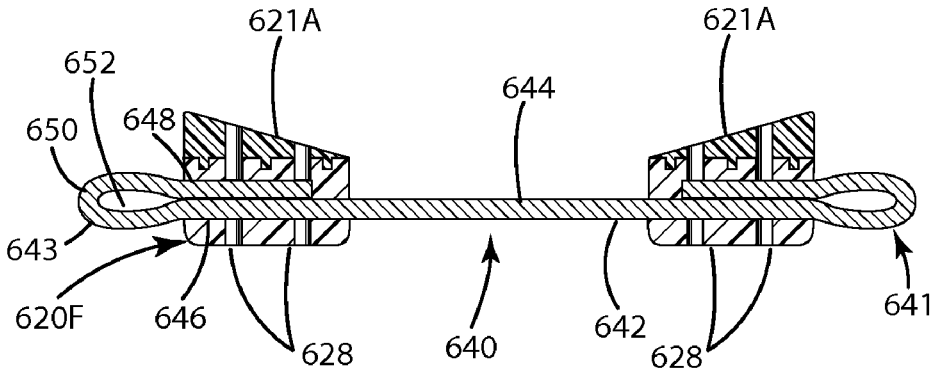
FIG. 41 is a cross section view of a lacrosse pocket of even another optional configuration of the sixth alternative embodiment.

The single layer runners can be constructed from a variety of polymeric materials, which include, but are not limited to, elastomeric materials, such as the thermoplastic polymers, thermoplastic polyurethane, thermoplastic resins, thermoplastic copolyesters, thermoplastic polyamides, polyolefin blends, styrenic block polymers, and elastomeric alloys, as well as rubber, formable but flexible resins, hydrophobic flexible materials, or similar flexible materials, or combinations of the foregoing. Where the material is hydrophobic, the single layer runners and the resulting pocket can be resistant to shrinkage or shape alteration due to moisture, and in many cases changes in ambient temperature. Optionally, the entire structure of each runner is formed from a single, monolithic piece of polymeric material, having different thicknesses and cross sections of components as desired. Further optionally, the single layer runners can be constructed of at least two materials. In one construction, the single layer runners can be constructed of two materials, the first material being different from the second material and where the hardness of the first material can be different from the hardness of the second material. For example, the durometer of the first material can be between 30 and 90 (Asker C), and optionally 80; and the durometer of the second material can be between 30 and 90 (Asker C), and optionally 72. As illustrated in FIG. 41, the first material can have holes for anchoring the second material. In this way, the first material and second material are joined or fused after completion of the molding process. Of course, optionally, the first material and second material can be joined or fused without anchoring holes.

Returning to FIG. 2, the front surface 21 can include multiple ridges 27 projecting from the front surface, generally aligned with the cross pieces 40. If desired, the ridges 27 alternatively can be offset relative to the cross pieces 40 and staggered therebetween. The rear surface 23 can define similarly spaced, similar ridges, if desired. Each of the ridges 27 can be distanced from one another by about 20 millimeters to about 25 millimeters on center, optionally about 23 millimeters on center. The single layer runner 20 and the cross pieces 40 can form a ladder like structure, with the single layer runners 20 being generally transverse, and optionally perpendicular to, the cross pieces 40.

As the ridges 27 form a part of the single layer runner 20, the cross-section of the ridges 27 can be similar to the variety of shapes described above. That is, the cross section of the ridges 27 can be rectangular with rounded edges, circular, triangular, square, diamond shaped, polygonal or irregular shapes. For example, as shown in FIGS. 36-42, a variety of shapes are shown.

Returning again to FIG. 2, the pocket 10, and more particularly, the single layer runners can be joined with a throat tie 60 at the ball stop end 22 of the runners. The actual joining of the throat tie 60 and single layer runner can vary as desired. As shown in FIG. 2, the throat tie end 62 is overmolded and generally encapsulated by the material forming the single layer runner 20 in a first portion 68 the throat tie. The throat tie 60 is also threaded through the holes 29 defined by the runner 20 so that it travels from the front surface 21 to the rear surface 23 of the runner 20, engaging the surfaces while extending generally parallel to the length of the single piece runner 20. Portions 66 of the throat tie are perpendicular to the longitudinal axis A of the single layer runner 20. Toward the lowermost portion of the single layer runner 20, a portion 67 of the throat tie also can be overmolded by the single layer runner if desired. Generally, the single layer runner 20 is overmolded over a first portion 68 of the throat tie and a second portion 67 of the throat tie with an intermediate portion 64 between those portions being generally exposed and threaded through the holes 29 defined by the single layer runner 20.

Figure 8:
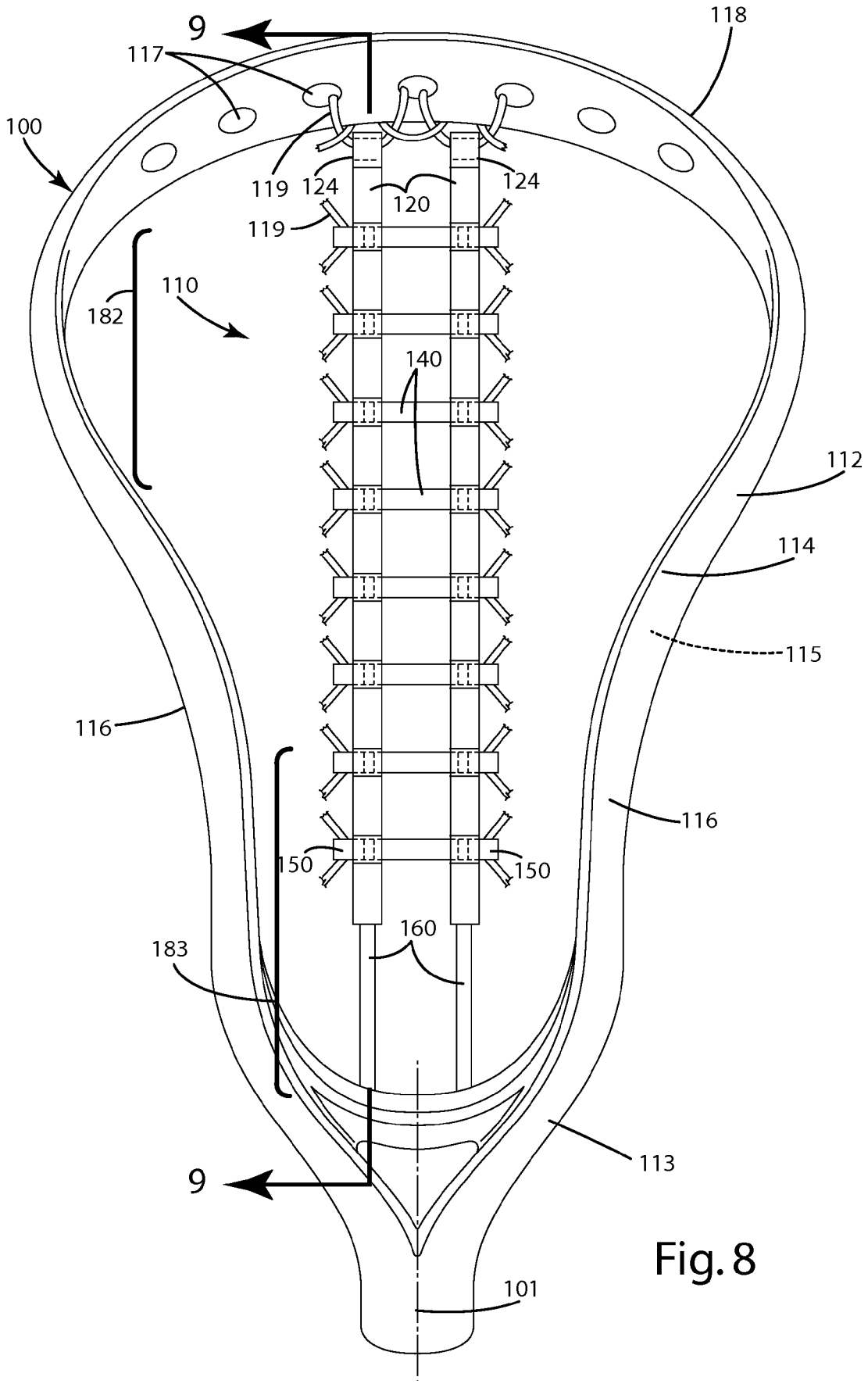
FIG. 8 is a front view of a lacrosse head including a first alternative embodiment of the lacrosse pocket.
Figure 9:
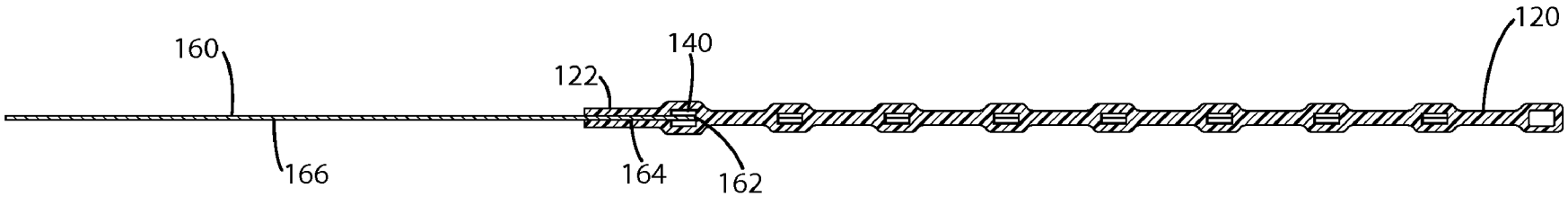
FIG. 9 is a cross section view of the lacrosse pocket of the first alternative embodiment taken along line 9-9 of FIG. 8.
Figure 10:
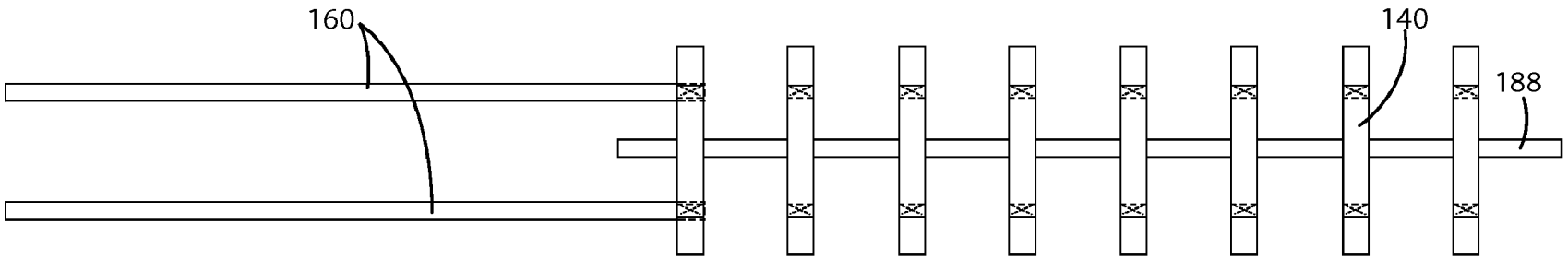
FIG. 10 is a bottom view of a pocket base of the first alternative embodiment before being overmolded.
Figure 11:
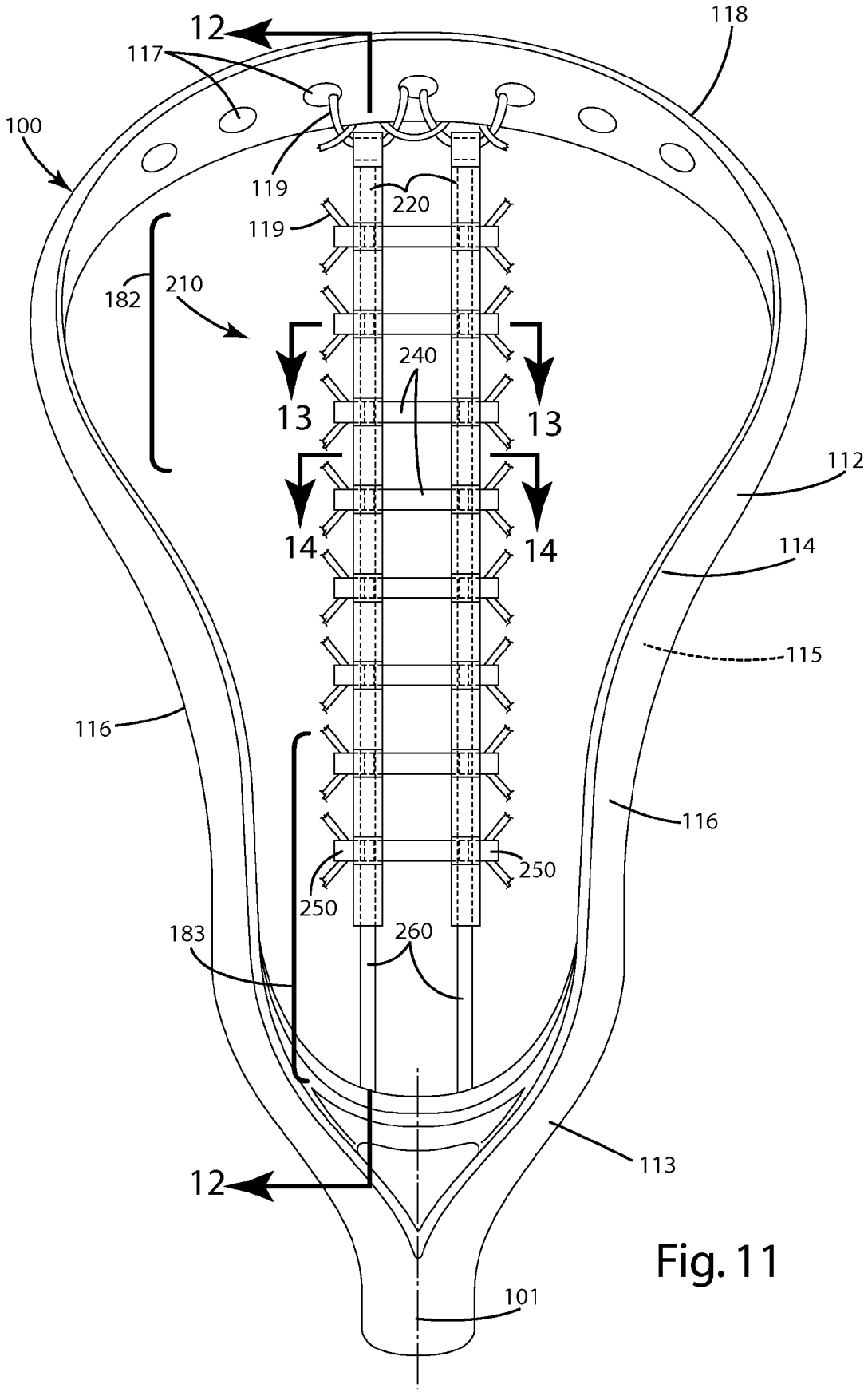
FIG. 11 is a front view of a lacrosse head including a second alternative embodiment of the lacrosse pocket.

Further optionally, the connection between the throat tie 60 and the single layer runner 20 can be altered. In a first alternative embodiment illustrated in FIGS. 8-10, the connection between the throat tie 160 and the single layer 120 varies from the embodiment illustrated in FIGS. 1-7. For example, the end of the throat tie 162 can be attached with a fastening structure directly to the cross piece 140. Suitable fastening structures include stitching, glue, cement, rivets, RF welds, melt welds and the like. With this construction, the end 162 is anchored to the cross piece 140. The material of the single layer runner near the end 122 can further encapsulate and cover the portion 164 of the throat tie 160. A remaining portion 166 of the throat tie 160 can remain uncovered by the overmolded material, and can be free to operate as a conventional throat tie to attach the runner to the frame 112 of the lacrosse head 100.

Referring to the current embodiment of FIGS. 1-7, the single layer runners 20 are joined with the multiple cross pieces 40. Each of the single layer runners 20 can be specifically overmolded over portions of the cross pieces 40. In general, the cross pieces are joined with the single layer runners 20 in a transverse manner, for example, the cross pieces can be perpendicular to the runners. In this configuration, a ladder-like structure of the pocket 10 is formed.

Each cross piece 40 can be constructed to form a material such as a web, twine, string or lace. Materials that can be used to make the cross pieces include ballistic nylon, a braided nylon web, natural leather, synthetic leather, fabrics, cloths, or other polymeric materials. Optionally, the single layer runners 20 can be constructed from one polymeric material, and the cross pieces 40 can be constructed from a second, different polymeric material, as mentioned above. Further optionally, both the single layer runners 20 and the cross pieces 40 can be molded together as a single piece to form the pocket 10, where the cross pieces 40 are a polymeric material, as mentioned above.

With reference to FIG. 3, each cross piece 40 can include a first end 41 and a second end 43. These separate ends can each be joined with or adjacent the respective single layer runners 20. The cross piece 40 can also include upper surface 42 and a lower surface 44. The upper surface 42 can generally face the front side of the lacrosse head, while the lower surface 44 can generally face the rear side of the lacrosse head. The cross pieces can also include speed loops 50 joined or formed at the ends 41 and 43. As shown in FIG. 3, these lace loops generally include a first portion 48 of the cross piece 40 which is folded back over a central portion 46 of the cross piece. This first portion can be sewn, adhered, glued, stapled, riveted or otherwise joined with the central portion. This first portion also can be joined with the central portion using other suitable joining methods, such as those described previously. For example, the first portion can be glued, RF welded, or melt welded to the central portion without stitching, and optionally sonic welded to the central portion without stitching. Further optionally, the fastening structure is concealed by the respective overmolded single layer runner 20. When the single layer runner is overmolded over the end of the cross piece, the opening 52 of the speed loop 50 remains exposed and formed adjacent the first end of the cross piece and generally extends laterally. The speed lace 50 generally extends laterally beyond the elongate single layer runner 20 a predetermined distance, optionally without extending all the way to the sidewalls of the head 100. Of course, if desired, the cross pieces of this embodiment could extend to the sidewalls. A net lace 119 (FIG. 1) can be adapted to fit through the opening 52 in the speed lace loop and can be joined further with the sidewall scoop and/or base depending on the location of the cross piece 40.

Figure 5:
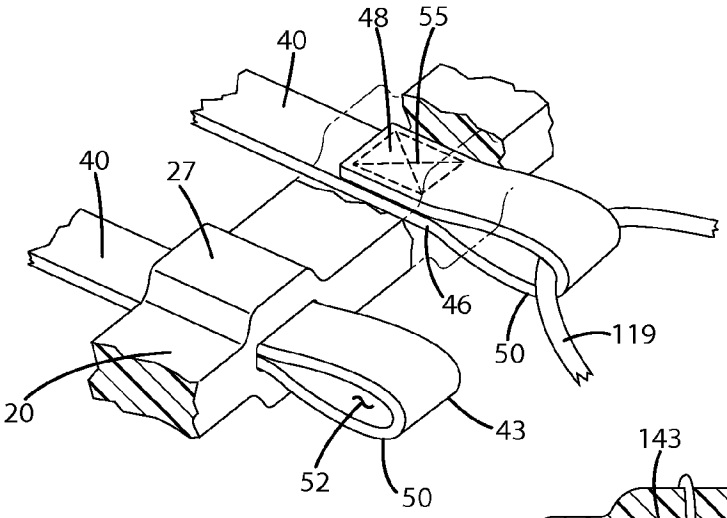
FIG. 5 is a partial view of a speed loop of the lacrosse pocket.

FIG. 5 illustrates a perspective broken view of the speed lace loops 50. There, the cross piece end portion 48 can be folded back over and stitched with stitching 52 to the central region 46. Of course, other fastening structures can be used to join these components of the cross piece 40 as desired. FIG. 5 also illustrates how a net lace 119 fits through the speed loop. As an example, they may be constructed from nylon or polyester twine.

The net lace 119 that can be used in connection with the cross pieces 40 or other components of the pocket 10 can be any conventional net lace, that is a lace, twine, web or other construction made from nylon, polyester or any other materials mentioned herein.

As shown in FIGS. 4, the cross section of the single layer runner 20 is void of any materials other than the material 20B which again can be any of the polymeric materials described above.

Figure 6:
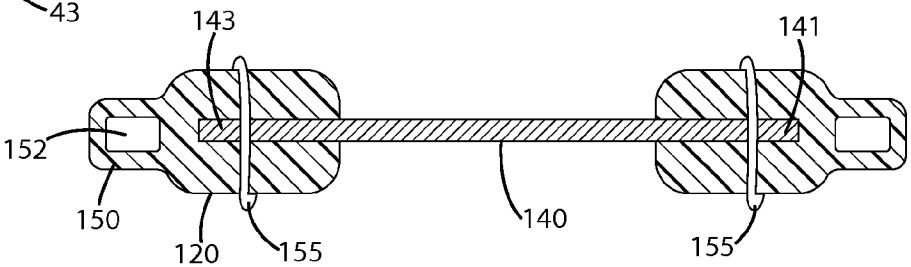
FIG. 6 is an alternative construction to the speed loop of FIG. 5.
Figure 7:
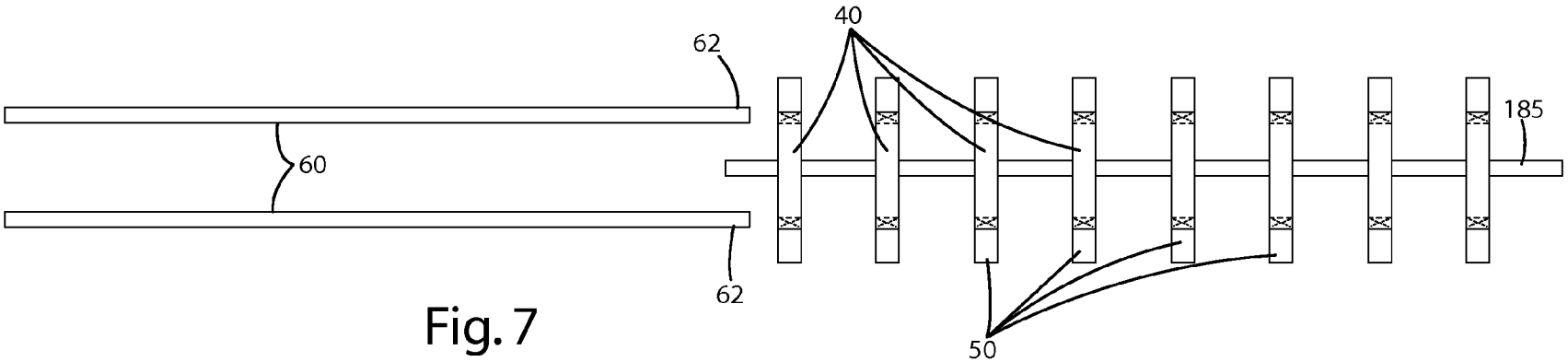
FIG. 7 is a bottom view of a pocket base before an overmolding step.

Optionally, the cross members can terminate adjacent and/or within the single layer runners. For example, as illustrated in FIG. 6, the cross piece 140 is a single elongated piece that terminates at opposing ends 141 and 143. These ends are overmolded by the single layer runners 120 to encapsulate the ends. For additional support, a stitching 155 or other fastening structure can be sewn or placed through at least a portion of the single layer runners, as well as through the ends of the cross piece that are overmolded by the runners 120. The runners themselves can include integrally molded loops 150 that define holes 152 through which net lacing is adapted to fit. The actual construction of the loops 150 can be of a variety of geometric shapes and cross sections as desired. As illustrated, the loops 150 can form a single piece with the respective single layer runners 120.

III. Method of Manufacture and Use

A method of manufacturing the lacrosse pocket of the current embodiment will now be described with reference to FIGS. 1-7. In general, the pocket 10 is designed to fit a lacrosse head 100 including opposing sidewalls extending between the scoop and the ball stop as shown in FIG. 1. To manufacture such a pocket, a pocket base or skeleton of the various components of the pocket are laid out in a mold that corresponds to the shape of the single layer runners and/or any other molded components desired to be included in the pocket 10. Specifically referring to FIG. 7, throat ties 60 are laid out in a predetermined spatial relationship relative to one another as well as the respective cross pieces 40. The cross pieces 40 are aligned at generally equal distant intervals from one another in the appropriate mold. To hold the cross pieces in a predetermined spatial relationship, an adhesive strip 185 can be adhered to the respective cross pieces 40 and hold the cross pieces in place relative to one another. Alternatively, a lace, string or rod can be positioned through the speed lace loops 50 of the respective cross pieces 40 to hold the cross pieces in a predetermined spatial relationship. With the various components placed in the mold, a material, for example, a polymeric material explained above, is overmolded over the cross pieces 40 and the throat ties 60 while the cross pieces 40 and throat ties 60 are maintained in the predetermined spatial relationship. During the overmolding, the polymeric material encapsulates at least a portion of the throat tie end 62, as well as portions of the respective cross pieces.

In this encapsulation, the polymeric material generally engages and covers at least a portion of the front surface 42 and the rear surface 44 of each of the respective cross pieces as well as the front surface and rear surface 61 and 69 of the throat ties (FIG. 2). The overmolded polymeric material in turn forms a single layer that becomes the single layer runners 20. In doing so, polymeric material connect the cross pieces to one another and to the throat tie. The mold for molding the polymeric material into the single layer runners can be constructed so that even after the overmolding operation, the cross pieces extend laterally beyond the single layer runners. Accordingly, the speed loops 50 and the openings 52 remain accessible so that net laces 119 can be placed there through.

Of course, where the speed loops are absent, for example, as shown in FIG. 6, the mold can be configured to form the integral loops 150 and the respective openings 152 through which the net lace 119 can be positioned.

A variety of techniques can be utilized for the molding process. For example, the polymeric material can be injection molded into a cavity formed above and/or below the respective throat ties and cross pieces. Alternatively, the polymeric material can be pour molded into a mold already containing the cross pieces and throat ties. Other molding operations and techniques can be used as desired.

In the molding process, a variety of the different components of the pocket 10 as described above can be formed. For example, the scoop and holes 26 and throat tie holes 29 can be formed in the single layer runner 20. Additionally, the mold can be configured so that it engages the throat tie end 62 to form kinks in it to attain the threaded configuration through the holes as shown in FIG. 2. Further, the ridges 27 can also be formed on the front surface and/or rear surface of the respective single layer runners 20.

Where the cross pieces 40 are preformed before including them in the mold, the speed loops 50 can be constructed by folding the end of the cross piece 40 back over itself and fastening these components with fastening structures as described above to form the respective speed loops.

After the single layer runners 40 are molded over the cross pieces and throat ties, the finished pocket 10 can be removed from the mold and allowed to cure. After it cures, flashing or trim can be removed from the single layer runners 20. Further, finishing operations can be performed so that the pocket 10 is ready for packaging or further processing. Given this preformed construction, the pocket 10 can be easily strung on a lacrosse head without significant skill.

IV. Second Alternative Embodiment

Figure 12:
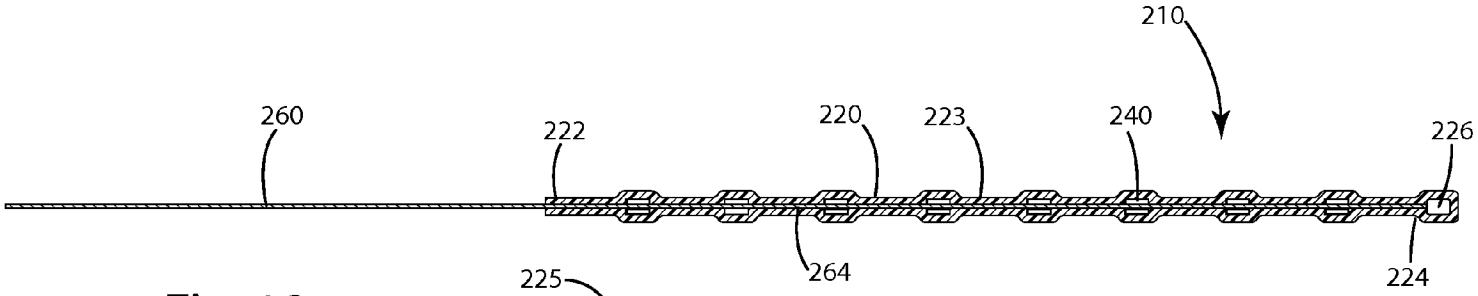
FIG. 12 is a cross section view of the lacrosse pocket of the second alternative embodiment taken along line 12-12 of FIG. 11.

A second alternative embodiment of the lacrosse pocket 210 is illustrated in FIGS. 11-15. This pocket 210 is generally identical to the pocket of the current embodiment described above, with several exceptions. For example, the runners 220 include a core 264 that is overmolded. The core 264 is joined with the throat tie 260. The core 264 can be constructed from the same material as the throat tie, and can extend from the ball stop end 222 to the scoop end 224 of the runners 220, as shown in FIG. 12. The core 264 can terminate short of the opening 226 defined by the scoop end 224, or it can form an end loop (not shown).

Figure 13:
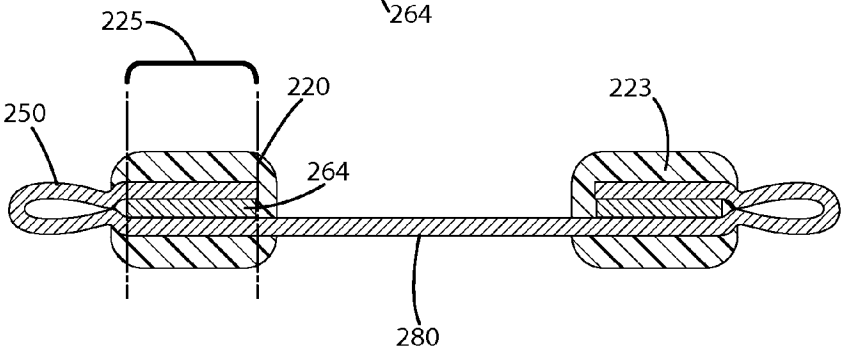
FIG. 13 is a cross section view of the lacrosse pocket of the second alternative embodiment taken along line 13-13 of FIG. 11.
Figure 14:
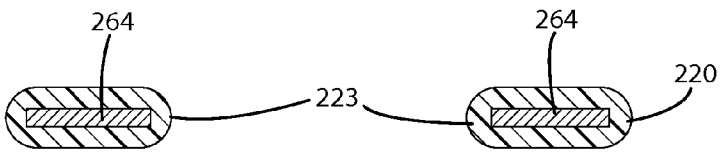
FIG. 14 is a cross section view of the lacrosse pocket of the second alternative embodiment taken along line 14-14 of FIG. 11.

With reference to FIGS. 13 and 14, core 264 can be embedded in and generally encapsulated by the surrounding overmolded material 223. In the region of the cross pieces 240, the core 264 can be secured between different portions of the lacrosse piece. For example, where the end of the cross piece 240 is doubled back over on itself, the core 264 can be interposed between the respective portions of the end of the cross piece 240 as shown in FIG. 13. These components can be stitched together with fastening structures at the junction 225 between them. The resulting lace loop 250 can extend laterally beyond the runners 220 as with the above embodiments.

Figure 15:
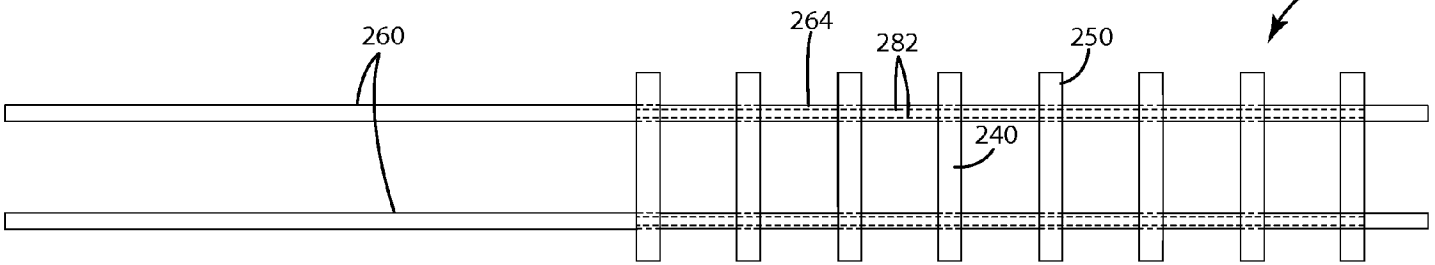
FIG. 15 is a bottom view of a pocket base of the second alternative embodiment before being overmolded.

To even further join the cores 264 to the cross pieces 240, stitching lines 282 can be run along the length of the cores 264 as illustrated in FIG. 15. The stitching 282 can overrun the cross pieces 240 and further join those cross pieces to the core 264. The method of making the pocket 210 is similar to that of the current embodiment described above. For example, the pocket base 212 shown in FIG. 15 is placed in a mold that is configured in the shape of and includes the contours of the runners 220. The mold is closed and material is overmolded over the components of the pocket base 212. The mold is constructed so that the molded polymeric material optionally does not cover the speed lace loops 250. Accordingly, these elements remain projecting out from the sides of the molded two layer runners 220. After the polymeric material is overmolded over the pocket base 212, the finished pocket 210 is removed from the mold and processed with the above embodiments.

V. Third Alternative Embodiment

Figure 16:
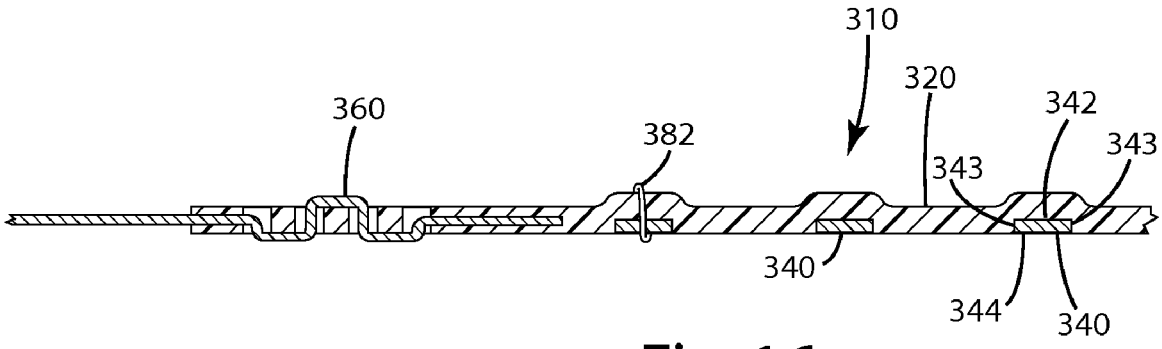
FIG. 16 is a cross section view of a third alternative embodiment of the lacrosse pocket.
Figure 17:
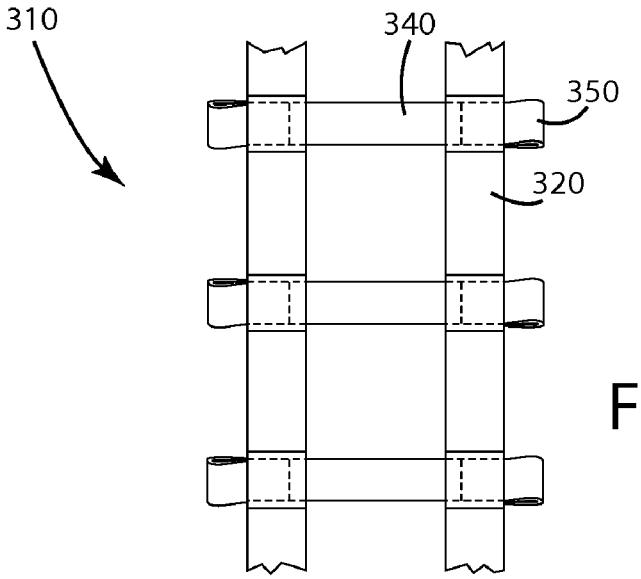
FIG. 17 is a top view of the third alternative embodiment of the lacrosse pocket.

The third alternative embodiment of the lacrosse pocket 310 is illustrated in FIGS. 16 and 17. This pocket 310 includes single layer runners 320 that are similar to the single layer runners of the current embodiment with several exceptions. For example, the runners 320 are overmolded over the respective cross pieces 340 in a slightly different manner. As shown in FIG. 16, the single layer runner 320 is molded over the cross pieces 340, it contacts and engages primarily the upper surface 342 and the sides 343 of the cross piece. The rear surface 344 of the cross piece remains generally uncovered by the overmolded polymeric material. In turn, the rear surface 344 of the cross pieces remain exposed and viewable in the finished lacrosse pocket 310. As with the current embodiment, the finished single layer runner is the only structure that spans between and joins the cross pieces 340. If desired, an optional fastening structure, such as a stitch 382, can join the cross pieces 340 and the material forming the elongated runner 320. The method of manufacture of this embodiment is similar to that of the embodiments described above.

VI. Fourth Alternative Embodiment

Figure 18:
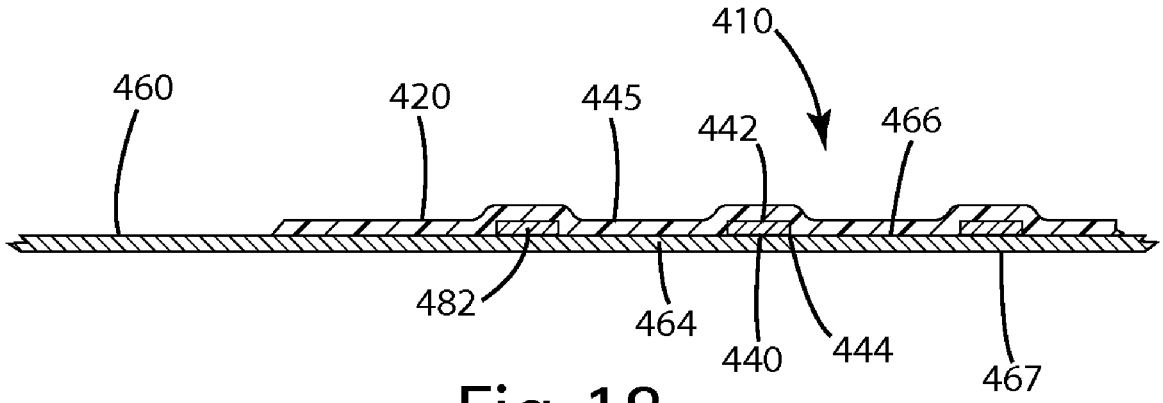
FIG. 18 is a cross section view of a fourth alternative embodiment of the lacrosse pocket.
Figure 19:
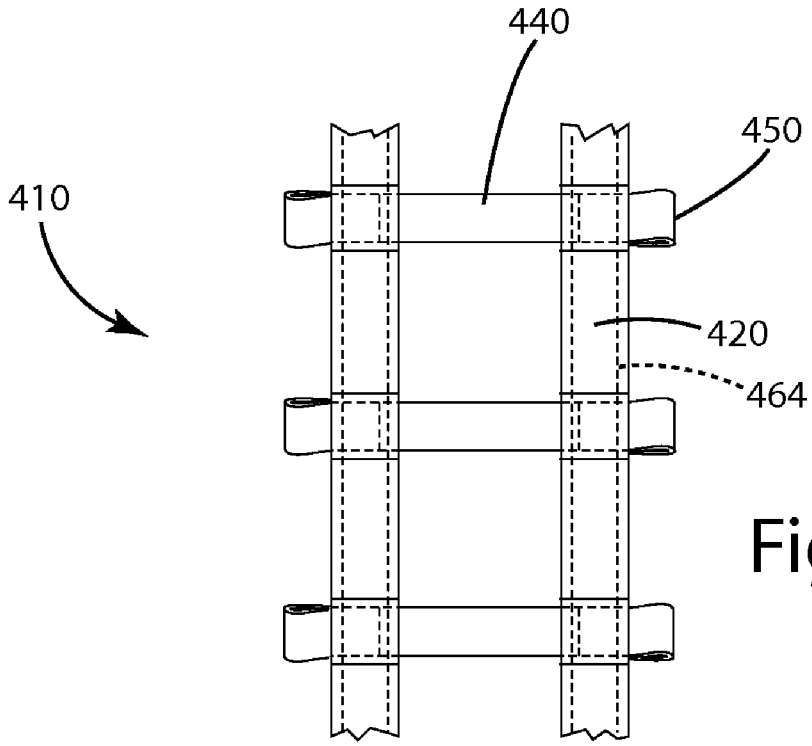
FIG. 19 is a top view of the fourth alternative embodiment of the lacrosse pocket.

A fourth alternative embodiment of the lacrosse pocket is illustrated in FIGS. 18-19. The lacrosse pocket of this embodiment is generally the same as the above embodiments with several exceptions. For example, the runner 420 includes a layer 464 of a second material that is different from the overmolded material 445. This second material can be a nylon web, braided material or any of the other materials described above. The second layer 464 can include an upper surface 466 that generally faces the front side of the head 114, and a rear surface 467 which generally faces the rear side of the lacrosse head 115. Cross pieces 440 are joined with the second layer 464 of the runners 420. In general, the cross pieces 440 are laid across the front surfaces 466 of the second layer 464. The rear surface 444 of the cross pieces can generally engage the front surface 466.

The cross pieces 440 can be joined with fastening structures to the second layer 464 as desired. The second layer 464 and the cross pieces 440 can form a pocket base. The pocket base can be overmolded by polymeric materials such as those described above. In general, the polymeric materials cover and/or encapsulates the front surface 466 of the second layer 464. The overmolded polymeric material also overlays and is overmolded to portions of the front surface 442 of the respective cross pieces 440. In this configuration, no openings are formed within the single layer runner, other than an opening at the scoop end and optional openings to accommodate a threaded through throat tie. The finished product also can include speed loops 450 that extend beyond the runners 420 laterally toward the sidewalls of the respective head 100 on with which the pocket is used.

VII. Fifth Alternative Embodiment

Figure 24:
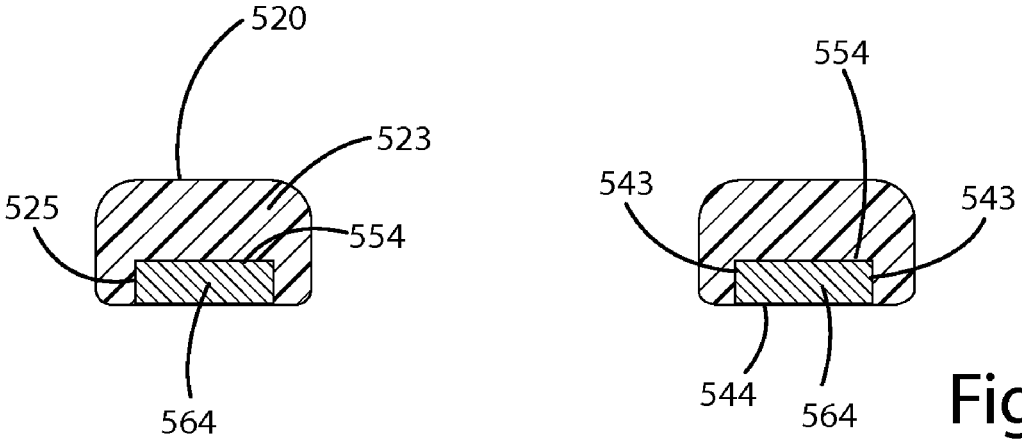
FIG. 24 is a cross section view of the lacrosse pocket of the fifth alternative embodiment taken along line 24-24 of FIG. 20.
Figure 25:
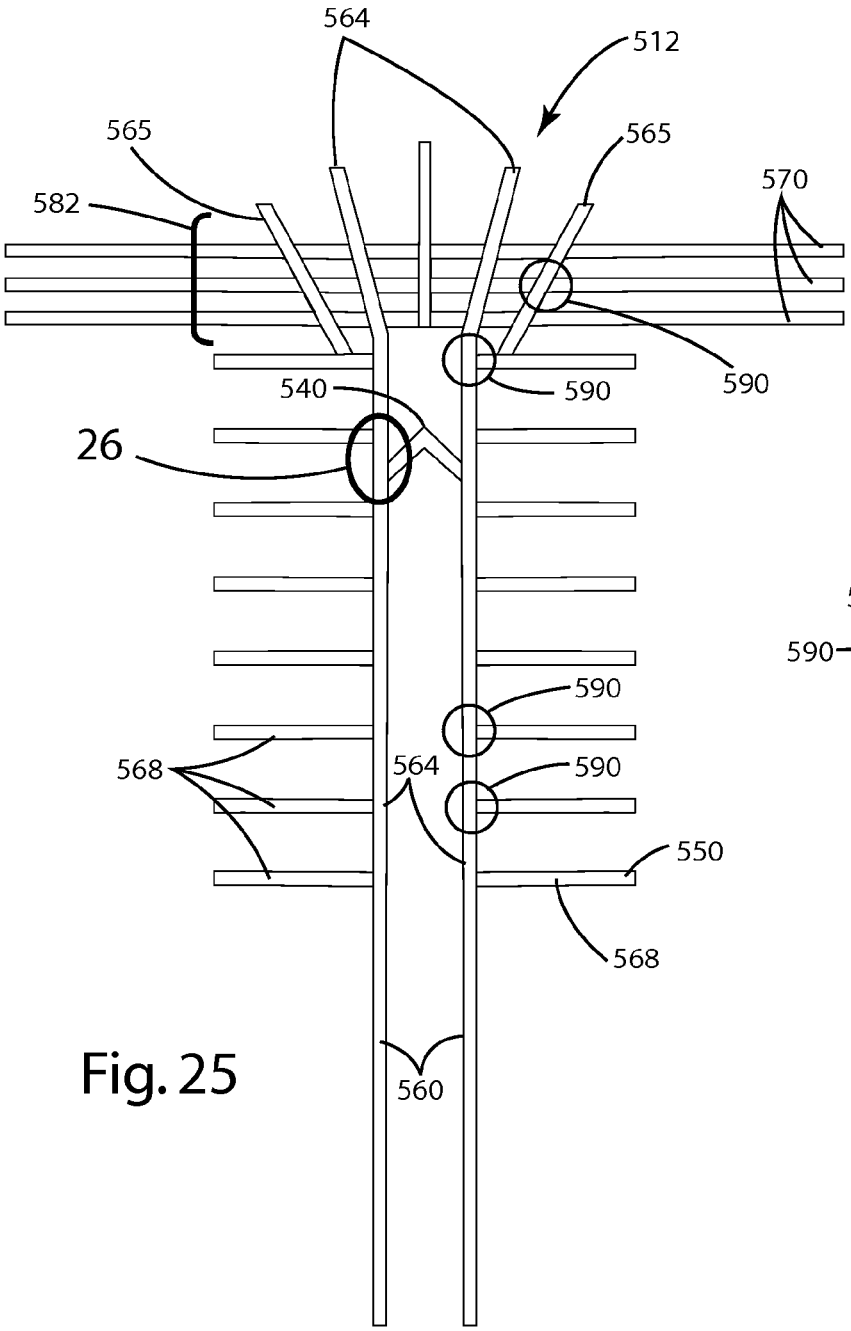
FIG. 25 is a pocket base of the lacrosse pocket of the fifth alternative embodiment before being overmolded.
Figure 26:
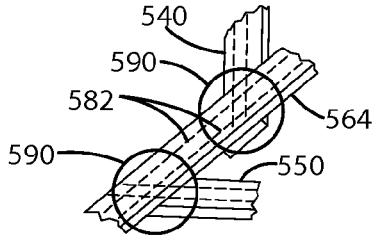
FIG. 26 is a partial view of the pocket base illustrating a joined cross piece and a lacrosse head side piece.

A fifth alternative embodiment of the lacrosse pocket is illustrated in FIGS. 20-26 and generally designated 510. This lacrosse head pocket is similar to the above embodiments with several exceptions. For example, the pocket 510 includes a pocket base 512. As shown in FIG. 25, the pocket base 512 can generally include multiple pocket base components, including but not limited to runner base 564, cross piece 540, side pieces 568, shooting strings 570, and ramp elements 565. These pocket base elements can be constructed in the form of webs, twine, string and/or laces, constructed from a variety of materials such as ballistic nylon, a braided nylon web, natural leather, synthetic leather, fabrics, cloths, or other polymeric materials.

The runner bases 564 are generally spaced from one another, and can extend longitudinally along the length of the pocket 510. One or more cross pieces 540 can be joined between and connect the runner bases 564. The cross piece 540 can be oriented transversely to the runners 564, optionally in a non-perpendicular manner, and generally positioned between the runners. The side pieces 568 can extend laterally from the runner bases 564.

Figure 21:
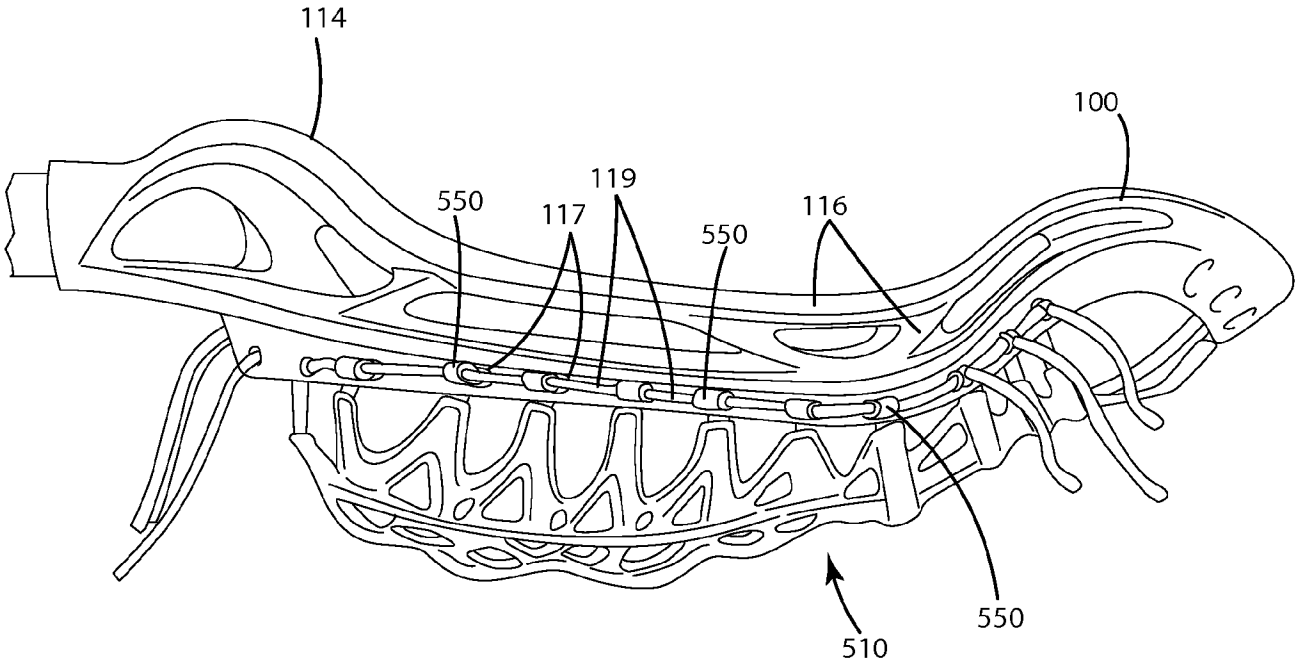
FIG. 21 is a side view of the lacrosse pocket of the fifth alternative embodiment installed on a lacrosse head.

Optionally, the side pieces and cross pieces are separate and different elements. For example, side pieces terminate at a runner, and do not cross to another runner. Likewise, the cross pieces do not extend to the sides of the lacrosse head like the side pieces. The side pieces 568 can terminate at their ends at speed lace loops 550 of the type described above. These speed lace loops, and thus the respective side pieces, can extend to and/or beyond the sidewalls, and can be adapted to be laced with net lace 119 on the outside, or optionally the inside, and/or through the sidewalls 116 of the lacrosse head 100 as illustrated in FIG. 21.

The runner bases 564 also extend toward the scoop 118 of the head 100. Adjacent the scoop, shooting strings 570 can be positioned transversely relative to the respective runner bases 564, generally in the ramp region 582 of the pocket base 512. As is known, these shooting strings are not considered side pieces or cross pieces, and they are optionally independent from these components of the pocket base. Moreover, the shoot strings can extend to the sides of the lacrosse head and/or scoop. The pocket base 512 can also include ramp elements 565 which can be joined to the side pieces 568 as well as the shooting strings 570. Optionally, these ramp elements 565, shooting strings 570 and side pieces 568 do not form part of the runner bases 564 nor portions of the runners 520 in the finished pocket 510.

Any of the pieces described above, for example, the shooting strings 570 or the ramp elements 565, as well as the runner bases 564 can terminate at speed lace loops 550 or other structures that connect them to the lacrosse head or net laces.

The various components of the pocket base 512 can be joined together at junctions 590 using a variety of fastening structures such as those described above. For example, in FIG. 26, the stitching 582 can be stitched through the runner base 564 and the cross piece 540, as well as the runner base 564 and the side piece 550. In general, the runner base 564 can engage one or more portions of the respective pieces, for example, the side piece 550 and/or the cross piece 540. The runner base 564 can be joined with that other piece at the junctions 590. Optionally, at the junction, the respective pieces and/or runners can be joined with a fastening structure as described above, for example, they can be sewn, stitched, adhered, RF welded, hot melted and/or integrally formed with one another.

Figure 22:
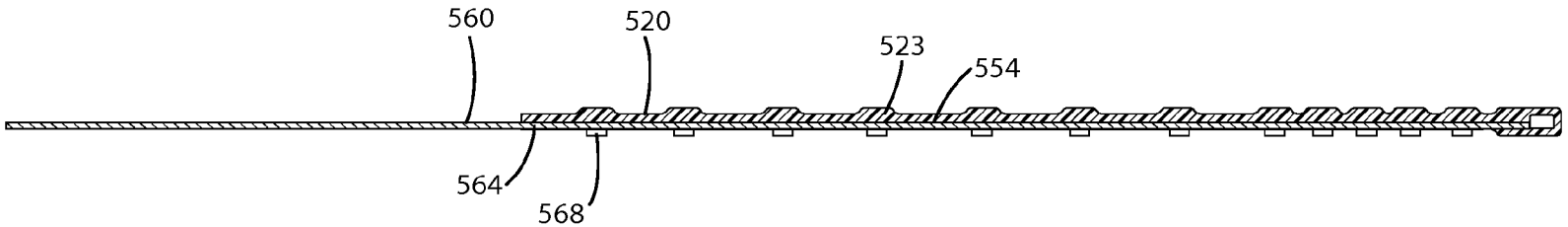
FIG. 22 is a cross section view of the lacrosse pocket of the fifth alternative embodiment taken along line 22-22 of FIG. 20.
Figure 23:
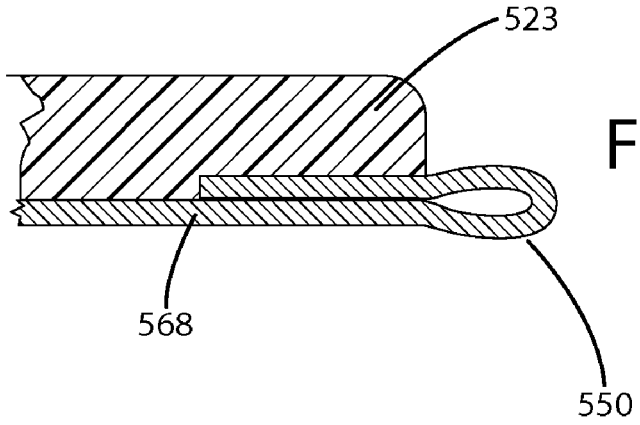
FIG. 23 is a cross section view of the lacrosse pocket of the fifth alternative embodiment taken along line 23-23 of FIG. 20.

As shown in FIGS. 20-23, the pocket base 512 and its components can be overmolded with a polymeric material of the type described above to form the completed pocket 510. Optionally, this overmolded material can form an exoskeleton 513 of the pocket. The overmolded material 523 can be molded over certain portions of the pocket base 512. As shown in FIGS. 22 and 24, the overmolded material 523 is joined directly with the front surface 554 of the runner base 564. For example, the overmolded material 523 of the runner 520 encapsulates the front surface 554 as well as the sides 543 of the runner base 564. The rear surface 544 of the runner base 564 can remain uncovered by the overmolded layer 520.

Figure 27:
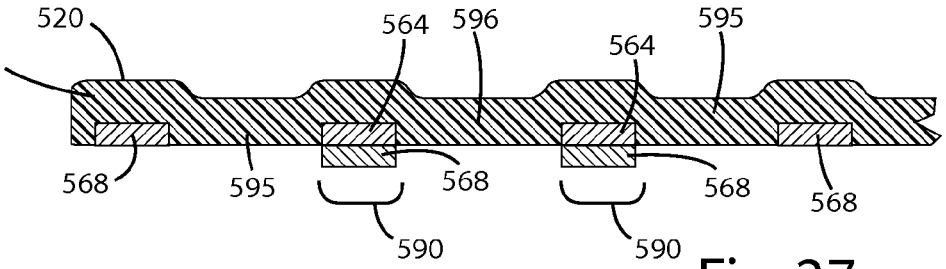
FIG. 27 is a cross section view of the lacrosse pocket of the fifth alternative embodiment taken along line 27-27 of FIG. 20.

The overmolded material 523 also can form one or more separate molded connection elements. For example, as shown in the cross section of FIG. 27, overmolded material 523 forms multiple connection elements 595 and 596 that extend between and independently connect the various pieces with one another and/or the runner bases of the lacrosse pocket 510. One type of connection element 595 can span between and connect the runner base 564 and the side piece 568. This molded connection element 595 is spaced away from and independent from the junctions 590 at which the side piece is joined with the runners. The connection element 595 can be constructed substantially only from the overmolded material 523. Optionally, nothing but the connection element 595 joins the runner base 564 and the side piece 568 in this region. Further optionally, for all the connection elements, there are no underlying side pieces, runners, base layers, shooting strings or ramp elements or cross pieces that further connect the components in the regions where the connection elements are located.

Another type of connection element 596 can be formed between adjacent runner bases 564. There, again, the connection element 596 is the only component connecting and spanning between the runner bases in that region. Another type of connection element 505 can be formed between the shooting strings 570, the runner bases 564 and the ramp elements 565. Yet other type of connection element 507 can be formed between the runner bases 564 and the ramp elements 565. Indeed, even other connection elements 506 can be formed between adjacent side pieces 568. These connection elements can join the various components of the pocket base 512 to one another in addition to and independently from the fastening structures and/or junctions that join the various pocket base components.

Figure 20:
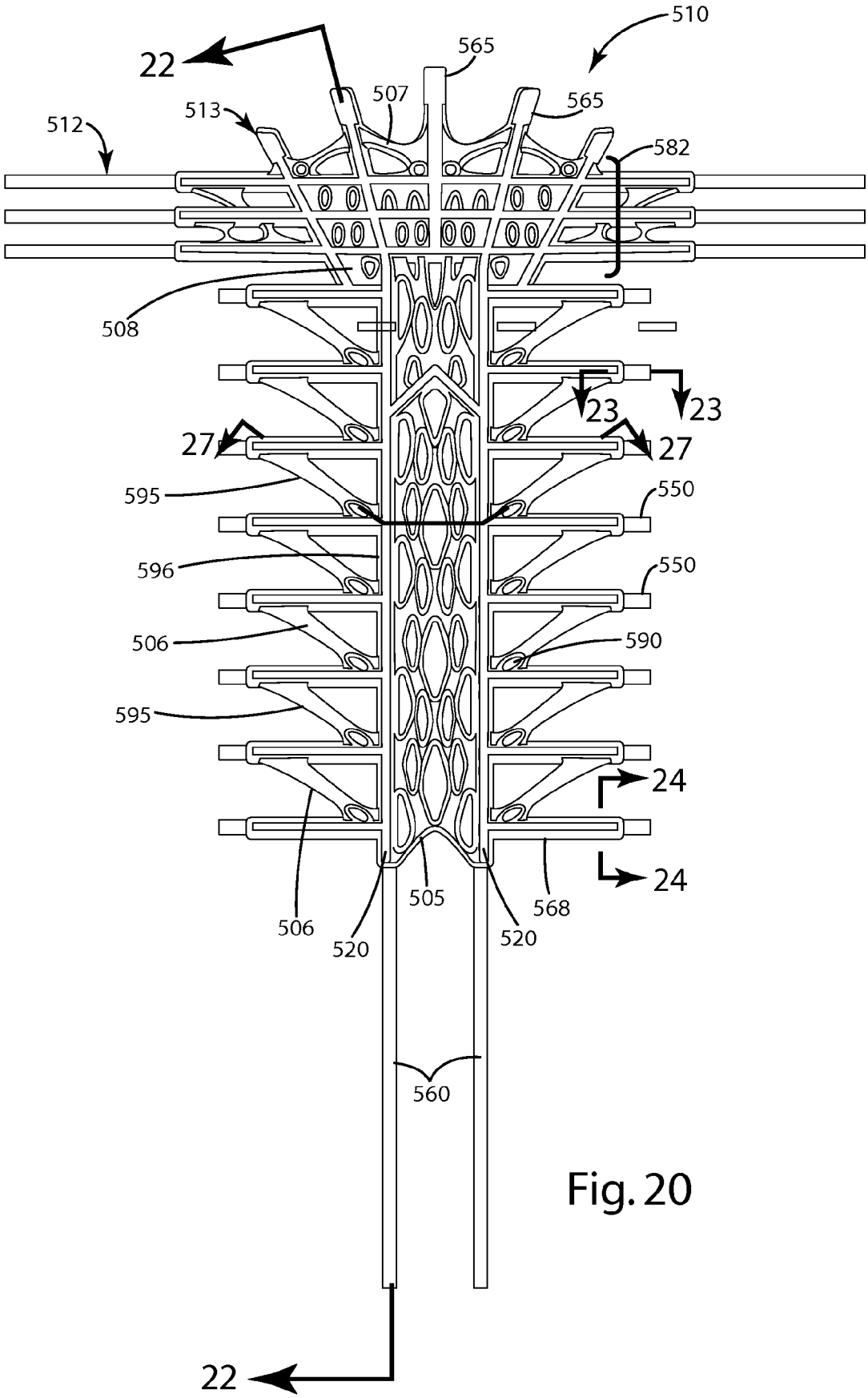
FIG. 20 is a front view of a fifth alternative embodiment of the lacrosse pocket before installation on a lacrosse head.

With reference to FIGS. 20 and 25, a method of manufacturing the pocket 510 of the fifth alternative embodiment will now be described. To begin, a pocket base 512 as shown in FIG. 25 is assembled from the desired pocket base components. These components can be joined with appropriate fastening structures, for example, by stitching, at various junctions of the components. The assembled pocket base 512 can be positioned in a mold cavity. Another portion of the mold is placed adjacent the pocket base 512. This second mold can be constructed so that it corresponds to the exoskeleton 513 of the pocket, which again, is in the shape of the finished overmolded material 523 of the pocket 510. Polymeric material can be introduced into the mold and can fill the portion of the mold cavity corresponding to the exoskeleton 513. As it is introduced, the material engages and covers portions of the runner base 564, side pieces 568, shooting strings 570, ramp elements 565, as well as various junctions 590 and cross pieces 540 of the pocket base 510. The mold portion that forms the exoskeleton 513, however, also can include additional cavities extending between selected ones of the runner, side pieces, ramp elements and shooting strings. These cavities fill and form the respective connection elements 505, 595, 596, 507, and 508 that span between different ones of the runners, cross pieces, shooting strings, ramp elements, and any other desired component of the pocket base 512. The connection elements join these pieces independently of any of the other respective pieces of the pocket base. As with the embodiments above, the overmolded material 523 can terminate short of the speed loops 550 or other structures used to connect the side pieces, shooting strings, runner bases or ramp elements to the respective sidewalls and/or scoops. The overmolded material 523 is allowed to cure, and the finished pocket 510 can be removed from the mold. After it cures, is trimmed and finished, it can be packaged for consumers.

In use, the pocket 510 can be laced onto a lacrosse head as illustrated in FIG. 21. Lacing of the pocket is a relatively simple procedure, which involves extending the ends of the side pieces 568 and/or loops 550 beyond the sidewalls (or through the sidewalls in certain applications) and threading a net lace 119 through the respective speed loops and the adjacent netting holes 117. The net lace 119 can be tied to itself or to designated locations on the frame 112 to secure the pocket 510 to the head 100.

Optionally, the overmolded layer 523 can be co-molded from materials of different density, or completely different materials altogether. For example, a high density TPU can be overmolded over the runner base layers 564, while a low density TPU can be overmolded over the side pieces 568. Alternatively, different materials, such as TPU and polyethylene can be overmolded over different elements of the pocket base 512. This two material overmolding can be performed using a 2-shot process, or other techniques for molding structures from two or more different materials.

Further optionally, the exoskeleton 513 can be die cut from a sheet of polymeric material. The sheet can be constructed of different materials or different densities in different regions to provide the desired thickness or flexibility in selected regions. The cut exoskeleton 513 can be attached with fastening structures to the pocket base 512.

VIII. Sixth Alternative Embodiment

A sixth alternative embodiment of the lacrosse pocket is illustrated in FIGS. 28-42 and generally designated 610. As with other embodiments described previously, this lacrosse head pocket can include single layer runners 620, which have a contact surface 621A and ridges 627 with chamfered portions for reducing large surface variations.

Figure 30:
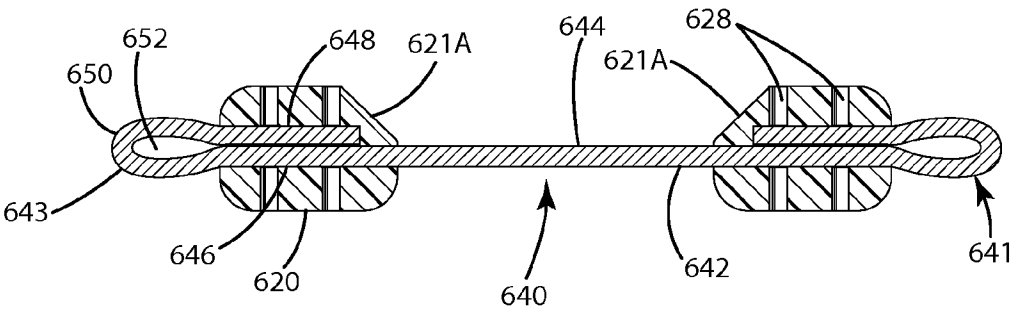
FIG. 30 is a cross section view of the lacrosse pocket of the sixth alternative embodiment taken along line 30-30 of FIG. 28.
Figure 42:
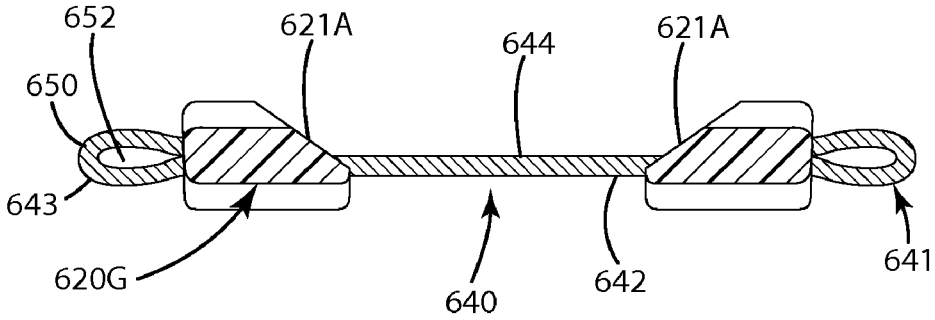
FIG. 42 is a cross section view of a lacrosse pocket of still yet another optional configuration of the sixth alternative embodiment.

The contact surface 621A portion of the ridges 627 can be constructed such that the contact surface 621A of the single layer runners 620 remains substantially flat or substantially rounded. For instance, the ridges 627 can include chamfering of the contact surface 621A as shown in FIG. 30. The selection of the chamfering of the ridges 627 can allow the contact surface 621A to transition smoothly, or remain substantially flat, as the ridges 627 project from the front surface 621. Of course, chamfering of the contact surface 621A at portions of the single layer runner 620 in addition to the ridges 627 can further allow the contact surface 621A to transition smoothly, or remain substantially flat, as the ridge 627 projects from the front surface 621. Such an optional construction is shown in FIG. 42. Further optionally, the edge of the chamfered contact surface 621A, where the contact surface 621 transitions to the side of the single layer runner 620A, can be rounded to transition smoothly. Additionally, the edge of the chamfered contact surface 621A that transitions to the remainder of the front surface 621 of the ridge 627 can be rounded. As discussed before, less variation in the contact surface 621A (less bulging or sloping) may increase ball control, retention, shooting accuracy or combinations of the foregoing.

Figure 31:
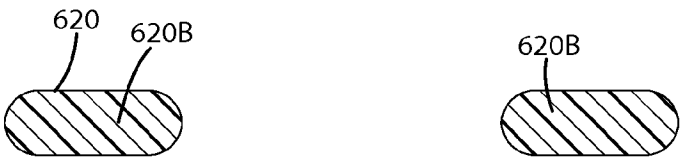
FIG. 31 is a cross section view of the lacrosse pocket of the sixth alternative embodiment taken along line 31-31 of FIG. 28.
Figure 32:
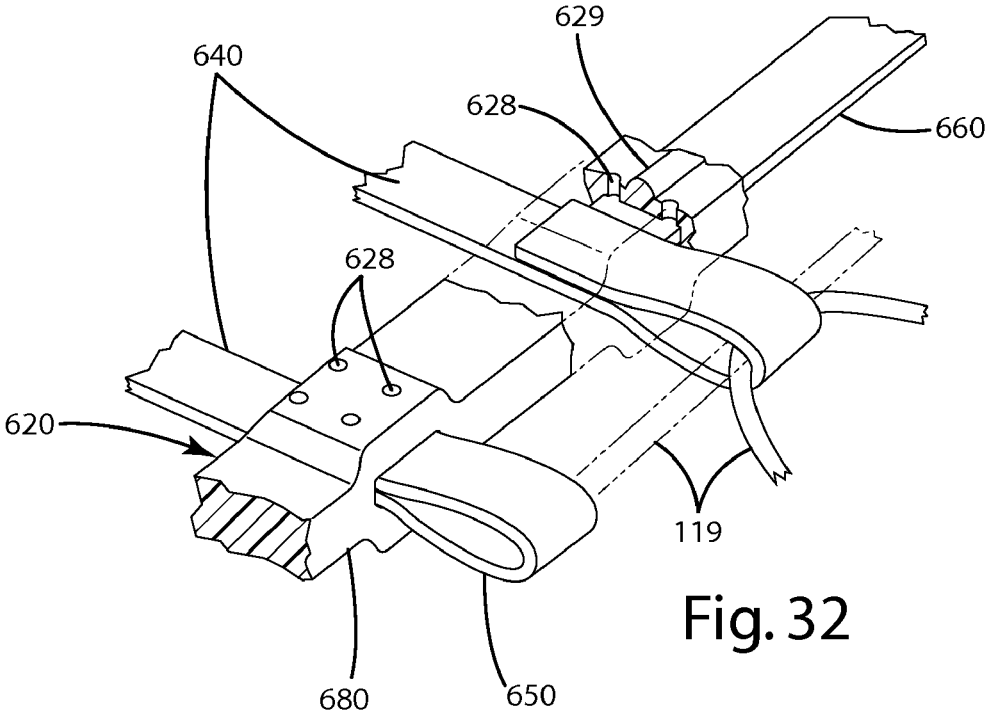
FIG. 32 is a partial view of a single layer runner and a throat tie of the sixth alternative embodiment.
Figure 36:
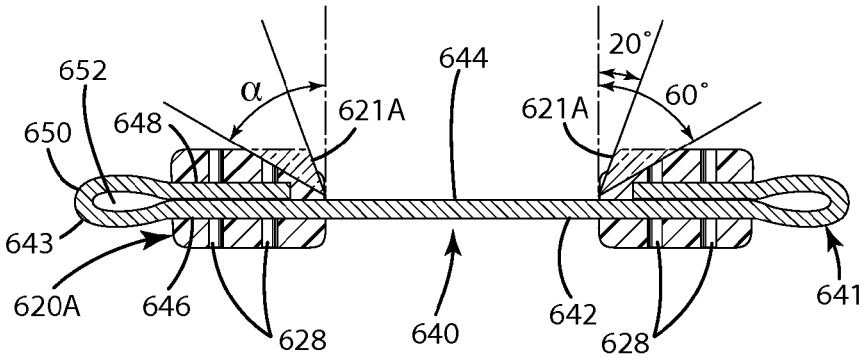
FIG. 36 is a cross section view of the lacrosse pocket of the sixth alternative embodiment.
Figure 37:
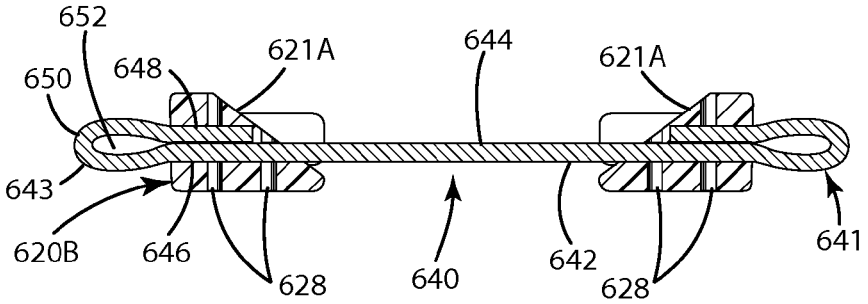
FIG. 37 is a cross section view of a lacrosse pocket of an optional configuration of the sixth alternative embodiment.

The chamfered portion of the contact surface 621A on the ridge 627 illustrated in FIGS. 31 and 36 has an angle of approximately 60° with respect to a vertical plane that is parallel to a side of the single layer runner 622 and the width of the contact surface 621A can be approximately 4mm (where the ridge 627 projects 2 mm from the front surface 621). Optionally, of course, the angle of the chamfered portion of the contact surface 621A can be 20° or optionally at least between 5° and 85°. As the angle increases, the surface area or width of the contact surface 621A on the ridge 627 increases. Conversely, as the angle decreases, the surface area or width of the contact surface 621A on the ridge 627 decreases. For example, at an angle of approximately 85°, the contact surface 621A on the ridge 627 may cover the full width of the ridge 627 depending on the configuration of the single layer runner 620. As another example, at an angle of 30°, the contact surface 621A on the ridge 627 may be about 2.3 mm in width. The angle of the chamfered portion of the contact surface 621A can be selected depending on desired lacrosse ball handling characteristics for the pocket 610.

Further optionally, the height at which the chamfered portion of the contact surface 621A on the ridge 627 intersects the side of the single layer runner 620 can be adjusted as desired. In the illustrated embodiment of FIG. 37, the chamfered portion of the contact surface 621A on the ridge 627 intersects the side of the single layer runner 620 below the height at which the front surface 621 between the ridges 627 intersects the side of the single layer runner 620. For example, the chamfered portion of the contact surface 621A may intersect the side of the front surface 621 between about 1 mm and about 4 mm below the upper surface of the front surface 621 and optionally about 2 mm.

Even further optionally, the chamfered portion of the contact surface 621A on the ridge 627 may intersect with the rear surface 623. More specifically, rather than intersecting a side of the single layer runner (as shown in FIG. 31), the chamfered portion cuts through to the rear surface 623. As with other embodiments, the cross pieces 640 may still be generally aligned with the ridges 627.

Figure 38:
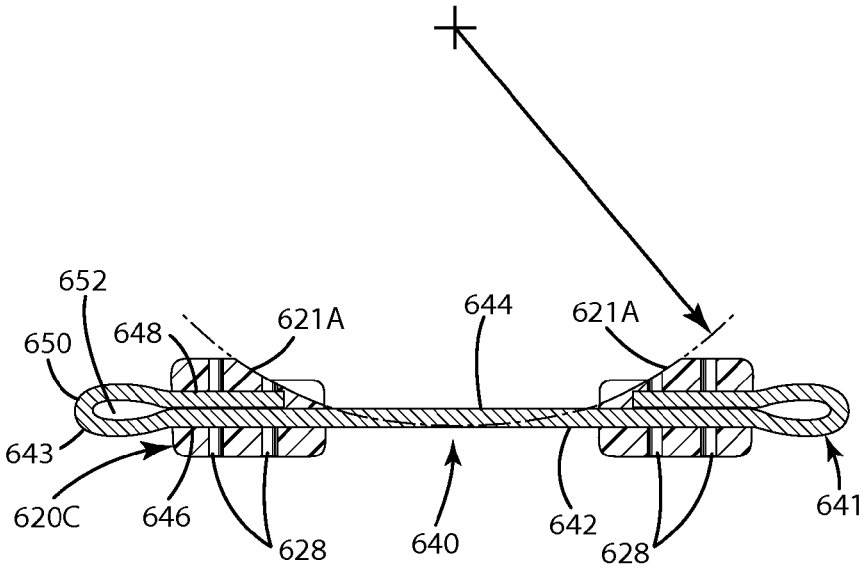
FIG. 38 is a cross section view of a lacrosse pocket of another optional configuration of the sixth alternative embodiment.

Another optional configuration of the contact surface 621A is shown in FIG. 38. Rather than being chamfered, the contact surface 621A on the ridge 627 can be constructed such that it is curved to substantially conform to the curvature of the lacrosse ball. For example, the contact surface can be concave, with opposing concave surfaces of opposing single layer runners facing one another. Optionally, the radius of the curved portion can be approximately 32 mm, but of course other radii can be selected, anywhere between 15 mm and 120 mm, or other dimensions depending on the application. Further optionally, the contact surface 621 between the ridges 627 also may be curved. Again, the curvature of the contact surface 621A shown in FIG. 38 can be concave, and may be selected to increase the amount of surface contact between the contact surface 621A and the lacrosse ball, resulting in greater ball retention, control, or both. For example, if the arc length of the curvature of the curved portion is increased, then the area of surface contact between the lacrosse ball and the contact surface 621A can be increased. Conversely, if the size of the curved portion is decreased, then the amount of surface contact can be decreased. Optionally, the curvature can be substantially circular, elliptical, or any curved path, as desired for lacrosse ball handling in the pocket 610. As an example, the curvature of the contact surface 621A on the ridge 627 can be circular with a radius greater or less than 32 mm, a horizontal offset +/− about 5 mm relative to the front surface 621, and a vertical offset +/− about 5 mm relative to the front surface 621.

Figure 40:
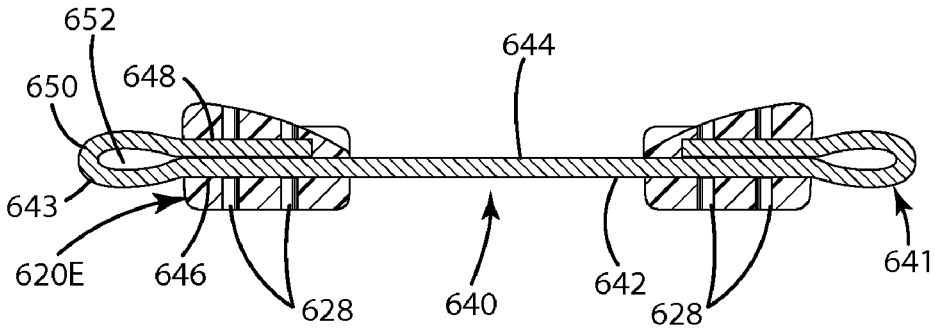
FIG. 40 is a cross section view of a lacrosse pocket of still another optional configuration of the sixth alternative embodiment.

Yet another optional configuration of the contact surface 621A is shown in FIG. 40. As illustrated, the curvature of the contact surface 621A on the ridges 627 can be convex; and as before, the curvature can be substantially circular, elliptical, or any curved path, as desired for lacrosse ball handling in the pocket 610. Additionally, the apex of the curvature of the contact surface 621A can be offset vertically or horizontally, as desired. For example, the apex can be offset horizontally toward the edge of the single layer runner 620 such that the slope of the contact surface 621A near the edge is more steep than the slope of the contact surface 621A on the opposite side of the apex.

Figure 39:
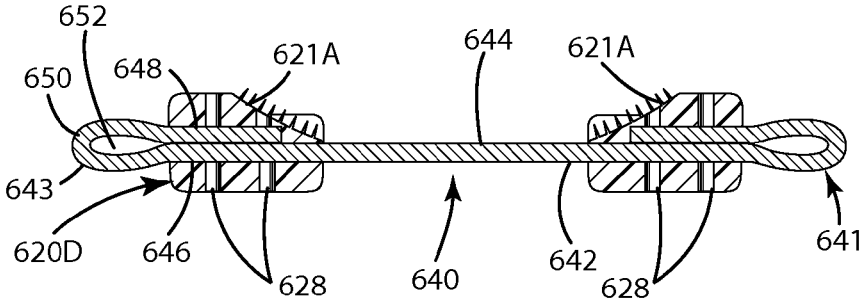
FIG. 39 is a cross section view of a lacrosse pocket of yet another optional configuration of the sixth alternative embodiment.

As described, the single layer runner 620 can be constructed to reduce large bulges or large depressions in the contact surface 621A. Ridges 627 that project from the front surface 621 can be chamfered, curved, or contoured to reduce variations in the contact surface 621A that can hamper lacrosse ball handling. Small protrusions, as shown in FIG. 39, can be added to the contact surface 621A in order to improve ball handling. More specifically, the small protrusions can increase ball grip and therefore improve particular handling characteristics. Optionally, the small protrusions can be distributed uniformly over the contact surface 621A. Alternatively, the small protrusions can be positioned at select locations to improve lacrosse ball handling. For example, the small protrusions can be positioned on the contact surface 621A of the ridges 627, or they can be positioned on the contact surface 621A between the ridges 627 and not on the ridges 627. As another example, the small protrusions can be positioned on portions of the single layer runner 620 other than the contact surface 621A, or they may be placed on the runner in related areas of the head. For example, the protrusions can be placed in the ball stop for increased retention there, but not in the scoop region.

Figure 43:
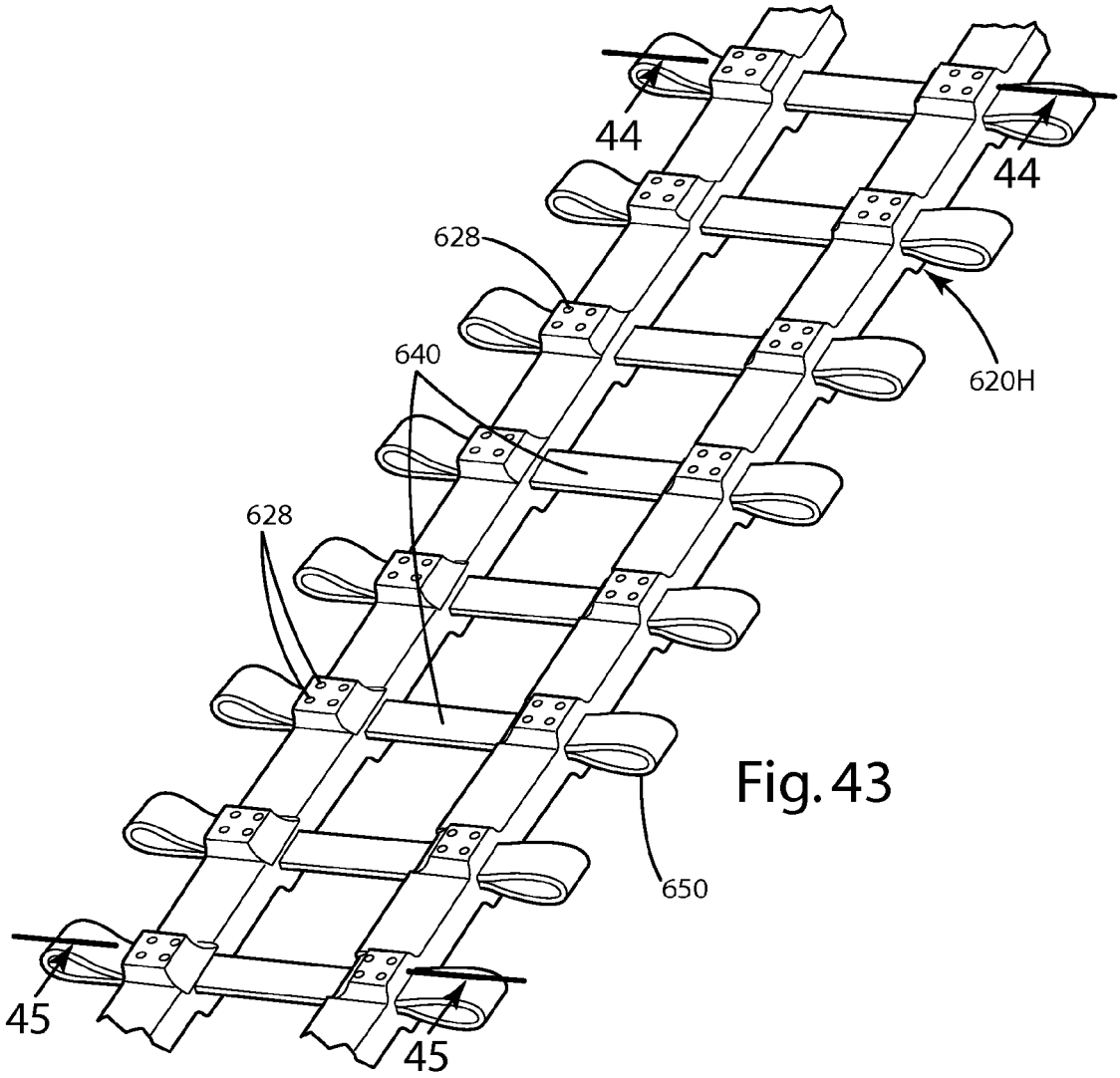
FIG. 43 is a perspective view of a lacrosse pocket of even still another optional configuration of the sixth alternative embodiment.
Figure 44:
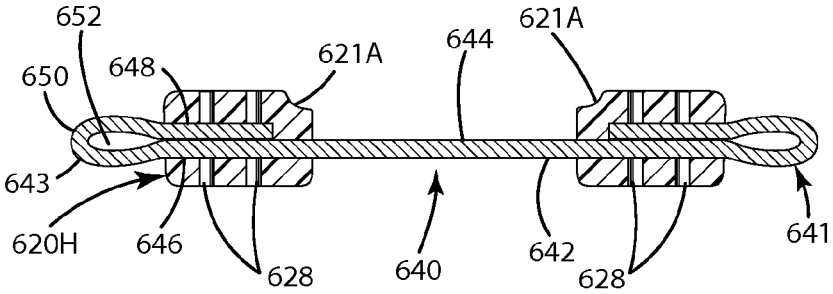
FIG. 44 is a cross section view of a lacrosse pocket of even still another optional configuration of the sixth alternative embodiment taken along line 44-44 of FIG. 43.
Figure 45:
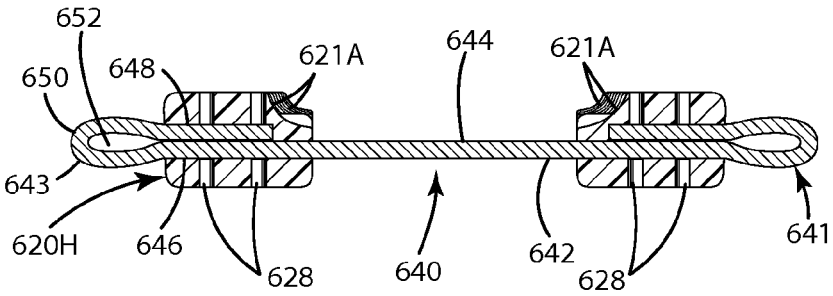
FIG. 45 is a cross section view of a lacrosse pocket of even still another optional configuration of the sixth alternative embodiment taken along line 45-45 of FIG. 43.

Even still another optional configuration of the sixth alternative embodiment is shown in FIGS. 43-45. The contact surface 621A can change from one end to the other end of the pocket 610. More specifically, the chamfering or rounding of the contact surface 621A can decrease toward the scoop region 182. Near the ball stop region 183, the area of the contact surface 621A can be larger such that a channel between single layer runners 620 is formed to grip the lacrosse ball more closely than near the scoop region 182. For example, the chamfering or curvature of the contact surface 621A near the ball stop region 183 can be deeper so that the lacrosse ball is gripped as the contact surfaces 621A of opposing single layer runners 620 flex toward each other. As the lacrosse ball leaves the ball stop region 183, during a shot, the channel becomes shallower toward the scoop region 182 (the area of the contact surface 621A decreases) to decrease the amount of surface contact between the lacrosse ball and the pocket, possibly resulting in less friction and increased velocity.

The change in chamfering or curvature of the contact surface 621A from the ball stop region 183 to the scoop region 182 can be continuous or stepped. As shown in FIGS. 43-45, the contact surface 621A portion of the ridges 627 decreases stepwise along the single layer runners 620. FIG. 44 illustrates a cross section of the pocket 610 near the scoop, and FIG. 45 illustrates a cross section of the pocket 610 near the ball stop region. Optionally, the progression of the contact surface 621A can include fewer steps than shown. For example, three or more of the contact surface 621A portions of consecutive ridges 627 can have about the same chamfering or curvature before stepping to a different size. As mentioned above, further optionally, the area of the contact surface 621A between the ridges 627 can be chamfered or curved, and therefore also can change from one end to the other of the pocket 610.

Even further optionally, the various other configurations of the sixth alternative embodiment can be varied similarly from one end to the other end of the pocket 610. Yet further optionally, combinations of the various configurations of the sixth alternative embodiment can be used at different portions of the pocket 610. For example, the ball stop region 183 may be curved and the scoop region 182 may be chamfered.

Referring to FIG. 28-34, a portion of the ridge 627 can be constructed such that its durometer is different from the durometer of other portions of the single layer runner 620. For example, a portion of the ridge 627 can have a hardness of 72 (Asker C) and the other portions can have a hardness greater than 72 (Asker C). As another example, portions of the single layer runners 620 near the ramp region 182 can have a different hardness from other portions of the single layer runners 620 near the pocket region 183. Hardness selection can be based on desired grip and flexibility in the pocket 610. Optionally, a portion of the ridge 627 and the other portions of the single layer runner can be constructed of different materials, as described previously and shown in FIG. 41, to vary the hardness of select portions of the single layer runner 620.

Figure 33:
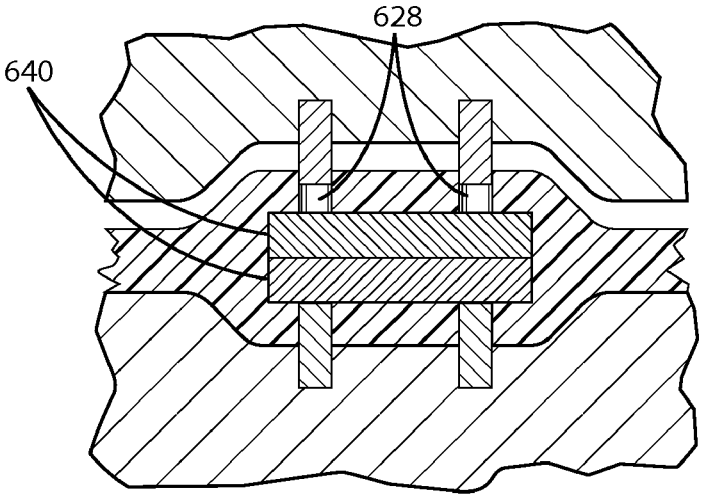
FIG. 33 is a cross section view of the single layer runner of the sixth alternative embodiment shown in the mold.
Figure 34:
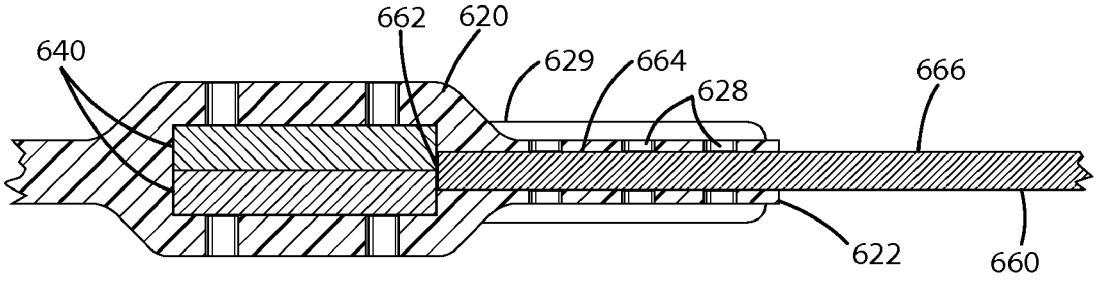
FIG. 34 is a cross section view of the single layer runner and a throat tie of the sixth alternative embodiment.
Figure 35:
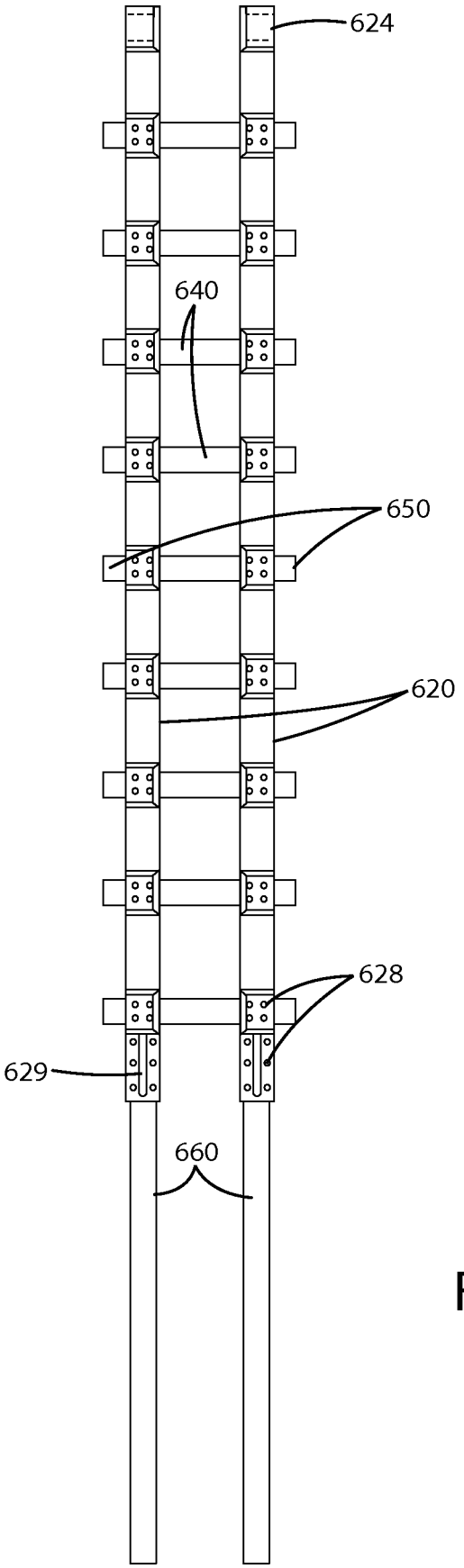
FIG. 35 is a front view of a pair of single layer runners and cross pieces of the sixth alternative embodiment.

The throat tie 660 of the single layer runner 620 of the sixth embodiment is also shown FIGS. 28-34. Specifically, the single layer runner 620 can be overmolded over the throat tie 660 as shown in FIG. 34. The throat tie 660 can abut the cross piece 640 and is at least partially encapsulated by the overmolded material of the single layer runner 620. In this configuration, the encapsulated portion of the throat tie 660 can be immovable relative to the single layer runner 620. Optionally, the throat tie end 662 can be less than 1 mm from the cross piece 640 or between 1 mm and 4 mm of the cross piece 640. In alternative embodiments, the throat tie can overlap the cross piece 640.

A support rib 629 can further strengthen the material of the single layer runner 620 that encapsulates a portion of the throat tie 660. The support rib 629 can extend along a portion of the throat tie 660 from near the first end 622 of the single layer runner 620 to about the cross brace 640 or a ridge 627. The support rib 629 can be formed of a harder, more rigid material than the material of the single layer runner 620 in order to add strength around portions of the single layer runner 620 that encapsulate the throat tie. This additional strength may help to prevent the throat tie from breaking free of the single layer runner 620. Of course, it can also be of the same material of the runner if desired Optionally, during the overmold process at manufacture, non polymeric components such as the throat ties 660 and cross pieces can be held in place using pins. As shown in FIG. 33, a cross section of a mold partially encasing the single layer runner 620 includes such pins. The upper half of the mold is raised to illustrate the holes 628 left by the pins during the molding process. As an example, the throat tie 660 can be held in place using one or more pins, optionally six to twelve pins, inside an injection die so that the throat tie 660 does not move when material is injected into the mold. The pins also can be used for three-axis alignment of the throat tie 660 in the die so that the throat tie 660 is overmolded at the desired position. If desired, the throat tie 660 can be located and held in place using alternative methods, without the pins being used. Although the overmold process is described with respect to the throat tie 660, similar pins can be used to hold and locate cross pieces 640 during manufacture. Holes 628 resulting from this process are shown throughout FIGS. 28-34. Further, the holes can optionally allow for fusion of the nylon of the throat tie 660 and the cross pieces 640 with the overmolded material of the singe layer runner 660 if desired.

Figure 28:
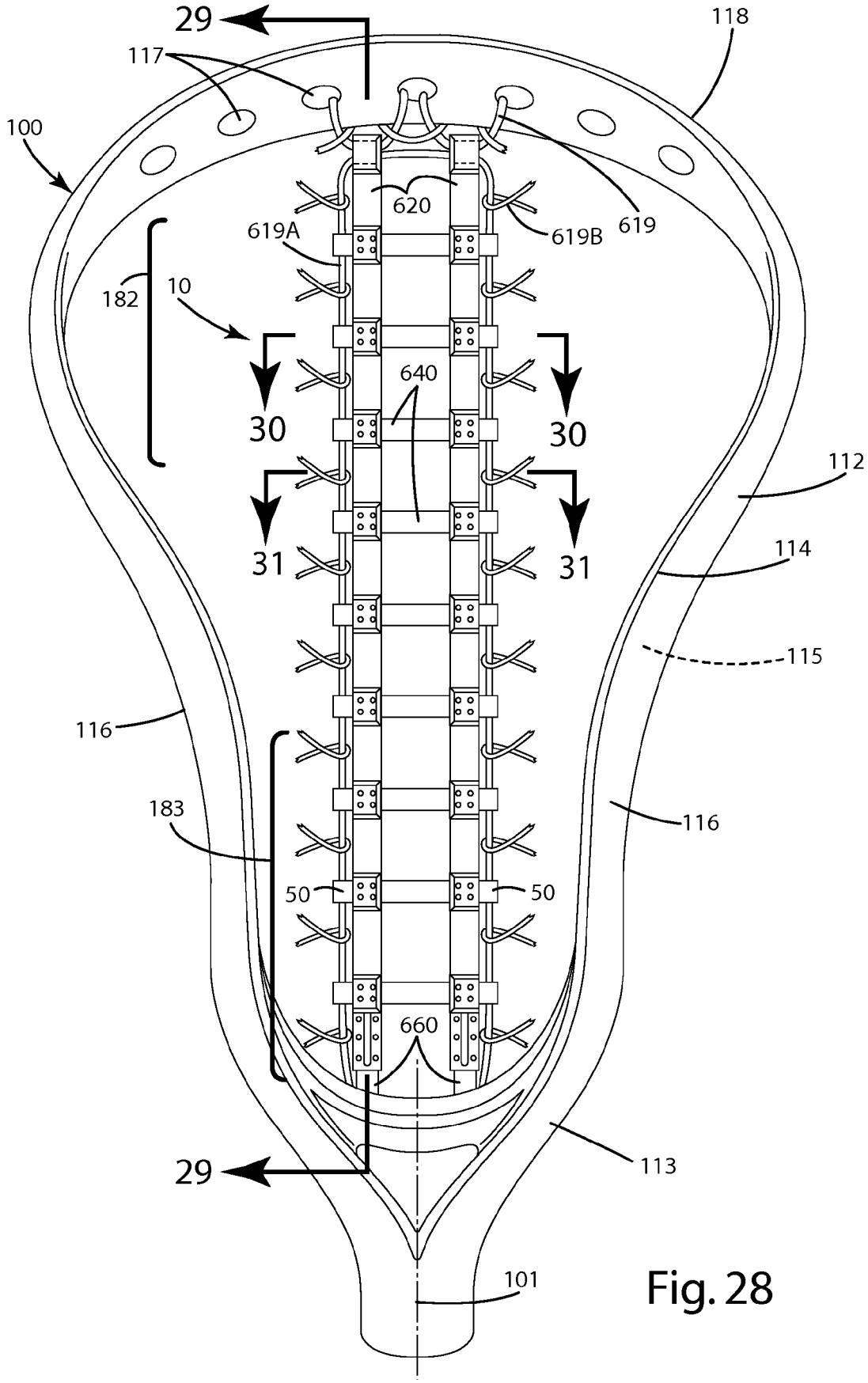
FIG. 28 is a front view of a lacrosse head including a sixth alternative embodiment of the lacrosse pocket.
Figure 29:
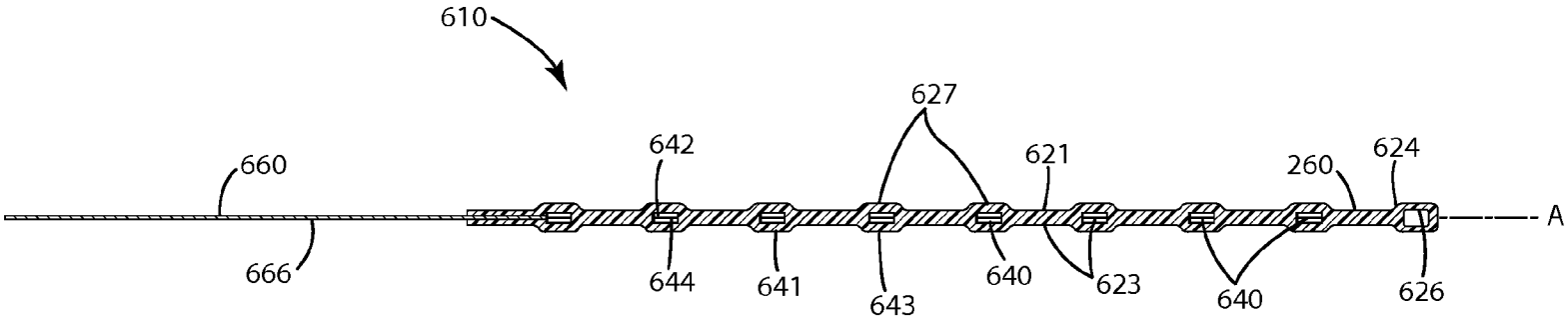
FIG. 29 is a cross section view of the lacrosse pocket of the sixth alternative embodiment taken along line 29-29 of FIG. 28.

FIG. 28 also shows an alternative lacing configuration for the pocket 610 of the sixth alternative embodiment. As before, the net lacing 619 is threaded through openings in the speed lace loops 650 of the cross pieces 640. However, a single lace 619*a* in this lacing configuration passes through each speed lace loop 650 of the pocket 610. The single lace 619*a* consecutively passes through at least three speed lace loops 650 along one single layer runner, and optionally, consecutively passes through each speed lace loop 650 along one single layer runner 620. Near the scoop 118, the single lace 619*a* passes through holes 626 of the single layer runners 620. And near the base 113, each end of the single lace 619*a* passes through a netting hole 117, or optionally through the same netting holes as the throat ties 660. Tie laces 619*b* can loop around portions of the single lace 619*a* between the speed lace loops 650, linking the single lace 619*a* to other portions of the net lacing 619. Optionally, each end of the single lace 619*a* may not pass through a netting hole 117 near the base 113. For example, the single lace 619*a* can pass through each speed lace loop 650 and cross between single layer runners 620 near the base 113. Holes (not shown) in the single layer runners 620 near the pocket region 183 or base 113 can allow the single lace 619*a* to cross between single layer runners 620. Further optionally, each end of the single lace 619*a* can pass through a netting hole 117 near the scoop 113. Even further optionally, the respective single lace 619*a* can be substantially parallel to the immediately adjacent single layer runners 620. If desired, the single laces 619*a* can be positioned on the outside of the runners, so that generally the laces 619*a* flank opposing sides of the central pocket 610.

With all of the embodiments described above, a durable and easy-to-install pocket and related method are provided.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A method of making a pocket for a lacrosse head, the lacrosse head including opposing sidewalls extending between a scoop and a ball stop, the method comprising:

providing a plurality of cross pieces having first and second opposing ends, each end including a speed loop defining an opening adapted to receive a net lace therethrough; and overmolding a polymeric material over the plurality of cross pieces to form first and second single layer runners with the polymeric material, the opening of the first end located adjacent the first single layer runner, the opening of the second end located adjacent the second single layer runner;

wherein the overmolded polymeric material is the only structure extending between and connecting a first cross piece and a second cross piece of the plurality of cross pieces;

wherein the first cross piece and the second cross piece are transverse to the first and second single layer runners.

2. The method of claim 1 comprising engaging a plurality of pins against the plurality of cross pieces to maintain the plurality of cross pieces in a predetermined spatial relationship.

3. The method of claim 2 comprising providing a throat tie, and overmolding the polymeric material over the throat tie.

4. The method of claim 3 where the throat tie includes a throat tie end, comprising placing the throat tie end near at least one of the plurality of cross members so that the overmolded polymeric material is molded over both the throat tie end and the at least one cross member, whereby the throat tie is joined with the at least one cross member by at least the overmolded polymeric material.

5. The method of claim 1 comprising forming a speed loop by folding the first end over a central portion of an individual cross piece.

6. The method of claim 5 comprising at least one of sewing, adhering, stapling, riveting and welding the first and second ends to the central portion.

7. The method of claim 1 wherein each of the plurality of cross pieces includes a central portion between the first end and the second end, comprising folding a portion of the first end over the central portion of the cross piece, and joining the folded portion of the first end with the central portion to form the speed loop and the opening.

8. A method of making a pocket for a lacrosse head, the lacrosse head including a ball stop, a scoop, opposing sidewalls extending between the scoop and ball stop, a front side and a back side, the method comprising:

providing a throat tie having a throat tie end and a plurality of cross pieces, at least one cross piece including a front surface adapted to face the lacrosse head front side and a back surface adapted to face the lacrosse head back side, the at least one cross piece including a first end, the first end including a speed loop;

engaging at least one of the plurality of cross pieces and the throat tie with a mold component to maintain the plurality of cross pieces together in a predetermined spatial relationship with one another and with the throat tie;

overmolding a polymeric material over the throat tie and the plurality of cross pieces while the cross pieces and the throat tie are maintained in the predetermined spatial relationship, the polymeric material encapsulating at least the throat tie end and at least one cross piece, with the polymeric material engaging and covering at least a portion of the front surface and at least a portion of the back surface of the at least one cross piece, wherein the overmolded polymeric material forms a single layer runner connecting the plurality of cross pieces to one another and to the throat tie, wherein the single layer runner is transverse to the plurality of cross pieces, wherein the cross piece extends laterally beyond the single layer runner so that the speed loop forms an opening through which a net lace is adapted to fit.

9. The method of claim 8 wherein the mold component is a plurality of pins, wherein the pins engage surfaces of the plurality of cross pieces to maintain the plurality of cross pieces in the predetermined spatial relationship.

10. The method of claim 9 wherein the overmolded polymeric material forms around the plurality of pins.

11. The method of claim 8 wherein each of the plurality of cross pieces includes a front surface and a back surface, comprising encapsulating at least a portion of at least one of the front surface and the back surface with the overmolded polymeric material.

12. The method of claim 8 comprising encapsulating each of the plurality of cross pieces at a plurality of junctions with the overmolded polymeric material so that each of the plurality of cross pieces is immovable relative to the single layer runner, and permanently attached thereto.

13. The method of claim 8 comprising folding each of the plurality of cross pieces back on itself to form a speed loop.

14. The method of claim 8 comprising forming a speed loop by folding a portion of the first end of the cross piece back over a central portion of the cross piece and joining the portion of the first end to the central portion so that the speed loop and the opening are formed adjacent the first end of the cross piece.

* * * * *